US008381468B2

(12) United States Patent
Koupal

(10) Patent No.: US 8,381,468 B2
(45) Date of Patent: Feb. 26, 2013

(54) MODULAR BUILDING STRUCTURE

(76) Inventor: Kenneth J. Koupal, Honolulu, HI (US)

( * ) Notice: Subject to any disclaimer, the term of this patent is extended or adjusted under 35 U.S.C. 154(b) by 0 days.

(21) Appl. No.: 12/435,234

(22) Filed: May 4, 2009

(65) Prior Publication Data

US 2009/0272056 A1 Nov. 5, 2009

Related U.S. Application Data

(60) Provisional application No. 61/050,587, filed on May 5, 2008.

(51) Int. Cl.
*E04B 1/38* (2006.01)
*E04C 2/38* (2006.01)

(52) U.S. Cl. ..... 52/282.1; 52/282.2; 52/582.1; 52/586.1

(58) Field of Classification Search ..... 52/586.2, 52/586.1, 282.1, 281, 239, 220.7, 238.1, 52/241, 242, 243, 282.3, 282.2
See application file for complete search history.

(56) References Cited

U.S. PATENT DOCUMENTS

| | | | | | |
|---|---|---|---|---|---|
| 3,871,153 | A | * | 3/1975 | Birum, Jr. | 52/794.1 |
| 4,021,973 | A | * | 5/1977 | Hegg et al. | 52/36.6 |
| 4,246,735 | A | * | 1/1981 | Herzfeld | 52/465 |
| 4,356,672 | A | * | 11/1982 | Beckman et al. | 52/36.6 |
| 4,430,834 | A | | 2/1984 | Rensch | |
| 4,601,137 | A | * | 7/1986 | Bates | 52/63 |
| 4,638,606 | A | * | 1/1987 | Wendt | 52/36.6 |
| 4,671,038 | A | * | 6/1987 | Porter | 52/586.1 |
| 4,852,317 | A | * | 8/1989 | Schiavello et al. | 52/239 |
| 5,125,201 | A | * | 6/1992 | Pieters et al. | 52/238.1 |
| 5,150,554 | A | * | 9/1992 | Quinlan et al. | 52/282.2 |
| 5,531,539 | A | * | 7/1996 | Crawford | 403/381 |
| 5,636,936 | A | * | 6/1997 | Kremser | 403/282 |
| 5,644,878 | A | | 7/1997 | Wehrmann | |
| 5,651,220 | A | * | 7/1997 | dit Felix | 52/81.5 |
| 5,682,719 | A | * | 11/1997 | Huang | 52/775 |
| 6,052,958 | A | * | 4/2000 | Miedema et al. | 52/284 |
| 6,178,702 | B1 | * | 1/2001 | Hand et al. | 52/36.6 |
| 6,244,002 | B1 | * | 6/2001 | Martin | 52/220.7 |
| 6,250,032 | B1 | * | 6/2001 | Davis et al. | 52/239 |
| 6,799,404 | B2 | * | 10/2004 | Spransy | 52/582.1 |

FOREIGN PATENT DOCUMENTS

FR 2 586 732 3/1987

OTHER PUBLICATIONS

English Abstract for French publication No. 2 586 732, published Mar. 6, 1987, in the name of Marcel Hepp, one sheet.
International Search Report and Written Opinion for corresponding PCT patent application No. PCT/US2009/042733, dated Jun. 25, 2009, 8 pages.

* cited by examiner

*Primary Examiner* — Brian Glessner
*Assistant Examiner* — Jessie Fonseca
(74) *Attorney, Agent, or Firm* — Christie, Parker & Hale, LLP

(57) ABSTRACT

Modular building structures and systems for construction of modular buildings are provided. A modular building structure according to one embodiment includes at least two panels having two outer skins and an inner core; at least two panel spacers between the outer skins of the panels; at least two panel connectors partially receiving the panels; at least one coupling bar; and at least one corner coupler configured to couple two of the panels substantially perpendicular to each other. A modular building structure may further include at least one straight coupler configured to couple two of the panels substantially parallel to each other.

12 Claims, 17 Drawing Sheets

12
100
13
19
19
14
15
14
12
18
14
13
13
15
12

MODULAR BUILDING STRUCTURE

CROSS-REFERENCE TO RELATED APPLICATION(S)

This application claims priority to and the benefit of U.S. Provisional Application No. 61/050,587, filed on May 5, 2008, the entire content of which is incorporated herein by reference.

FIELD OF THE INVENTION

The present invention relates to modular building structures.

BACKGROUND

The use of modular building structures and systems has increased in recent years in an attempt to reduce construction costs, simplify the construction process, and reduce construction time. Modular building structures are constructed by assembling a number of pre-fabricated components, which may be manufactured under controlled environmental conditions and assembled either in the controlled environment or at the installation location of the structure. One recognized benefit of modular building structures is the relative ease of transporting the individual components to remote locations and assembling the structures in such locations. For instance, modular building structures have been assembled in locations without available roads after the components have been transported to the locations by helicopter.

SUMMARY OF THE INVENTION

Building structures according to certain embodiments of the present invention include a number of repeated interconnected components that provide a rigid and lightweight structure. According to various embodiments of the present invention, one or more of the following benefits may be achieved: modular building structures may be quickly assembled at or distant from an installation site using few or no fasteners; building structures can be assembled at relatively low cost due to the small number of differing parts and a relative reduction in the amount of material required for the structure; modular building structures may be assembled without the need for heavy industrial equipment or skilled labor; the components of the modular building structure can be easily shipped because the components may be packed flat; modular building structures can be easily built that are structurally strong, thereby providing a high degree of safety and security to inhabitants and/or equipment housed within the structure.

By their system of construction, embodiments of these modular building structures are inherently sealed against infiltration by dust, smoke, or water. Certain embodiments are also fire-retardant or even fireproof.

According to an embodiment of the invention, a modular building structure includes a plurality of panels, each panel being of generally rectangular construction and comprising a pair of generally parallel outer skins sandwiching an inner core. A plurality of panel spacers are provided, one at each edge of each panel to hold the outer skins of a panel spaced from one another. Each panel spacer defines a pair of flanges with each flange abutting the inside surface of an outer skin of the panel.

A plurality of panel connectors are also provided. In general, a panel connector is provided for each panel spacer. Each panel connector defines a pair of outer grooves and a pair of inner slots. The inner slots receive and mate with the pair of flanges of the corresponding panel spacer, one of the two outer grooves of each of two adjacent panel connectors align with one another to form a coupling channel when the corresponding panels are arranged generally perpendicular to and adjacent one another. A coupling bar is then keyed into each coupling channel to couple a pair of adjacent panel connectors to one another. A plurality of edge couplers mate with the other groove of each of adjacent panel connectors to lock two adjacent panel couplers to one another.

According to another embodiment of the invention, a modular building structure includes a plurality of panels, each panel having a pultruded structure of generally rectangular construction and comprising an outer skin enclosing an inner core on four sides. According to this embodiment, two edges of the outer skin can include integral panel connectors which also function as panel spacers, and for such an embodiemnt an assembly jig may not be needed for assembly.

DETAILED DESCRIPTION

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the figures and description are to be regarded as illustrative in nature, rather than restrictive.

Figure 1:
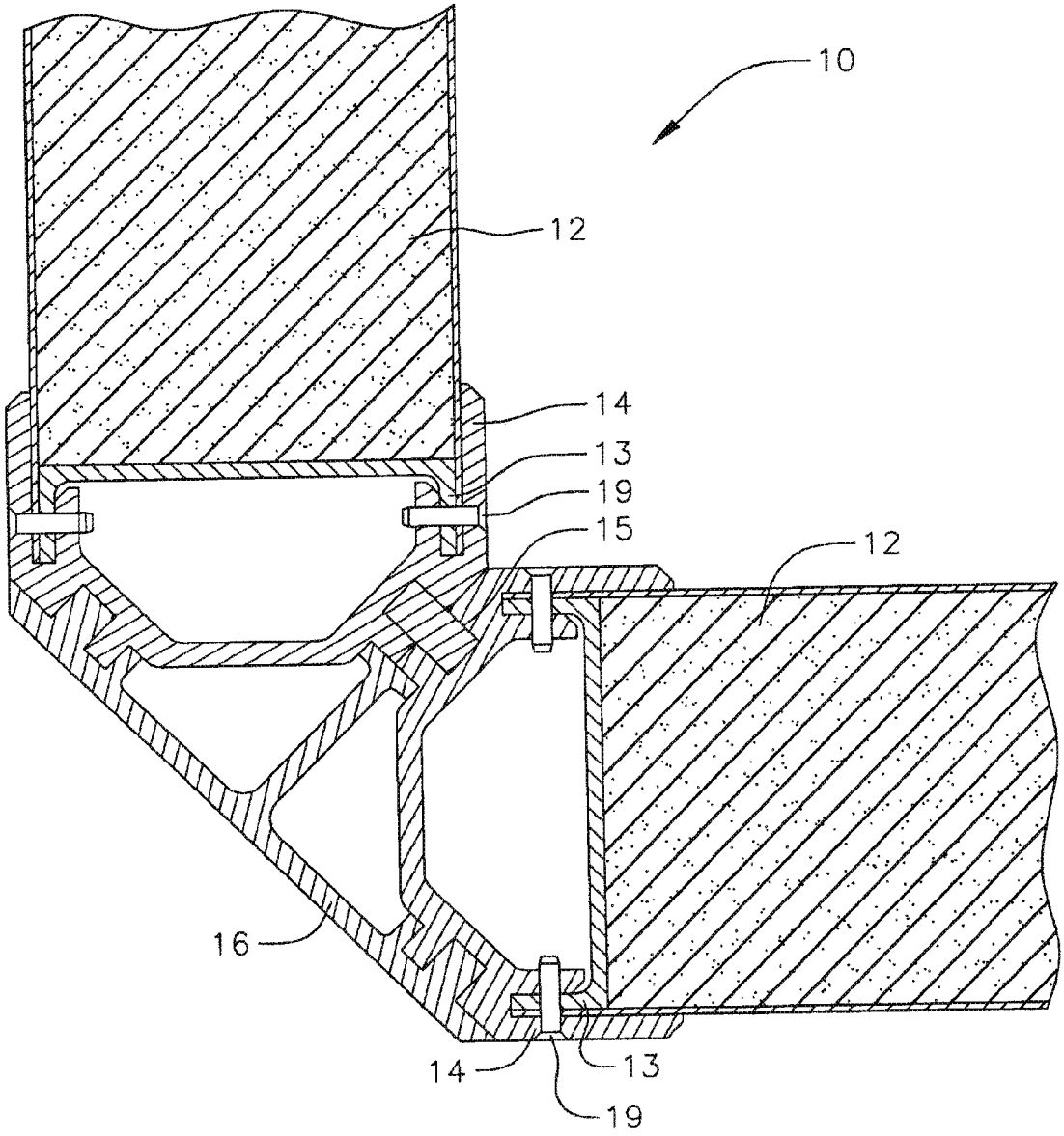
FIG. 1 is a sectional view of assembled components of a modular building structure according to one embodiment of the present invention.

FIG. 1 shows a sectional view of assembled components of a modular building structure 10 according to one embodiment of the present invention. The modular building structure 10 includes at least two panels 12; at least two panel spacers 13; at least two panel connectors 14; at least one coupling bar 15, and at least one edge coupler, in this embodiment, a corner coupler 16. As shown in FIG. 1, the two panels 12 of the modular building structure 10 are generally perpendicular to each other and are connected to each other utilizing a combination of the panel spacers 13, the panel connectors 14, and the coupling bar 15. The corner coupler 16 further locks the two panels 12 in place relative to each other.

Figure 2:
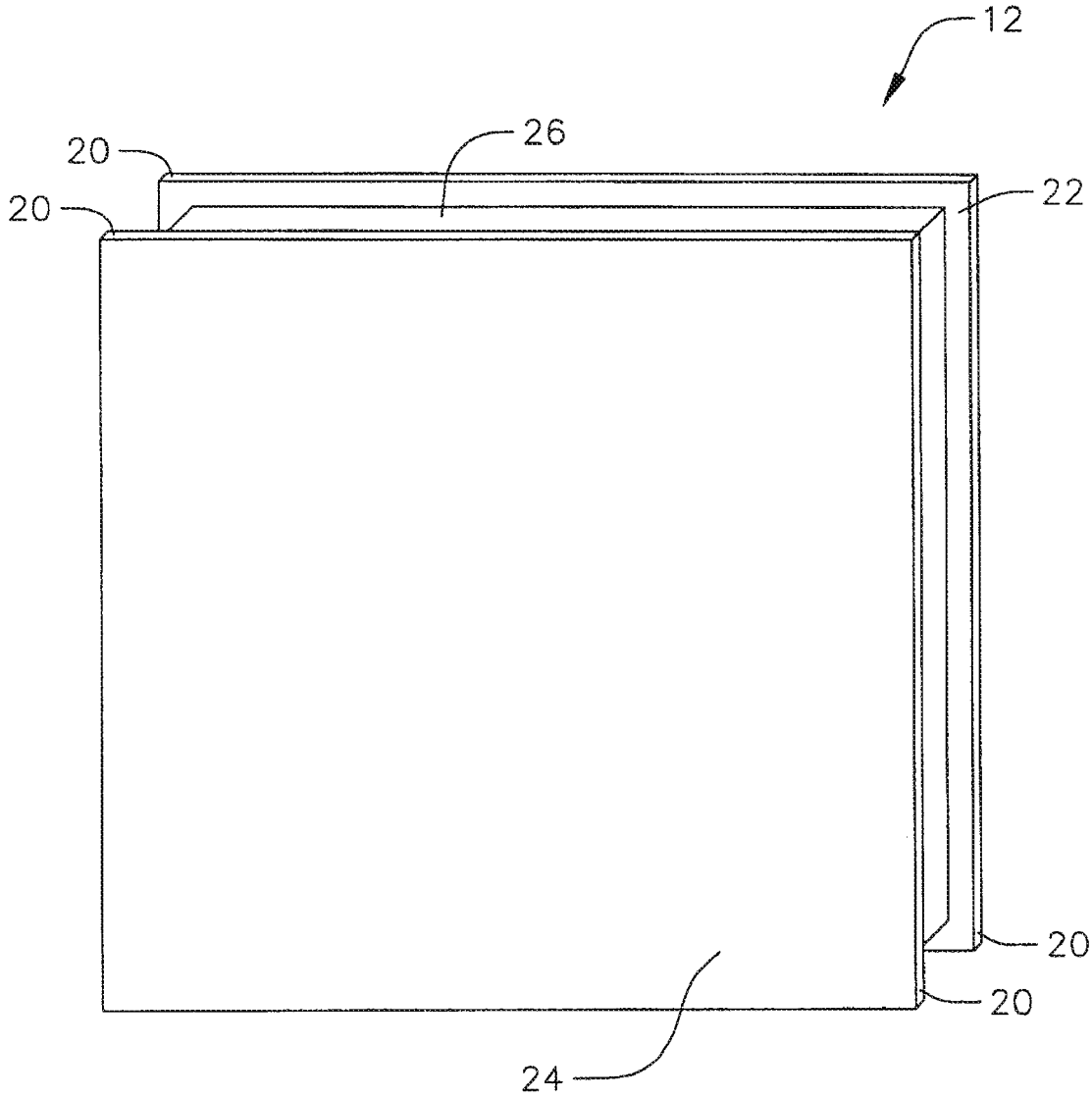
FIG. 2 is a perspective view of a panel of the modular building structure of FIG. 1.

With reference to FIG. 2, each panel 12, according to one embodiment, is generally rectangular in shape. In a finished structure, the panels correspond to the floor, ceiling and walls of the structure. Each panel 12, according to one embodiment, includes two outer skins 20. The two outer skins 20 have generally the same shape and dimensions and are generally parallel and spaced apart from each other, sandwiching an inner core 26. More specifically, each of the two outer skins 20 has an inner surface 22, the inner surfaces 22 of the two outer skins 20 spaced apart and facing each other, and two outer surfaces 24, the two outer surfaces 24 facing away from each other. The outer skins 20, in one embodiment, are formed of sheets of aluminum. Alternatively, the outer skins 20 may be formed of any other suitable materials such as metal, plastic, fiberglass, or the like. In one embodiment, the skins are spaced such that the panels 12 have a thickness of between approximately 2½ inches (60 mm) and approximately 3 inches (75 mm).

The panels 12, according to one embodiment, further include the inner core 26 sandwiched between the two outer skins 20. The inner core 26 has generally the same shape as the two outer skins 20. However, the outer perimeter of the inner core 26 does not extend all the way to the outer perimeter of the panel 12 forming a perimeter gap. This perimeter gap of the inner core 26 is configured so that the perimeter edges of the panel 12 can receive panels spacers 13. According to one embodiment, the inner core 26 is be formed of a reticulated foam material. Alternatively, the inner core 26 may be formed of any other suitable material. Further, in one embodiment, the inner core 26 is bonded to each of the inner surfaces 22 of the two outer skins 20 using a suitable adhesive. Alternatively, the inner core 26 may be fastened to the two outer skins 20 by any other suitable materials or methods.

Figure 3:
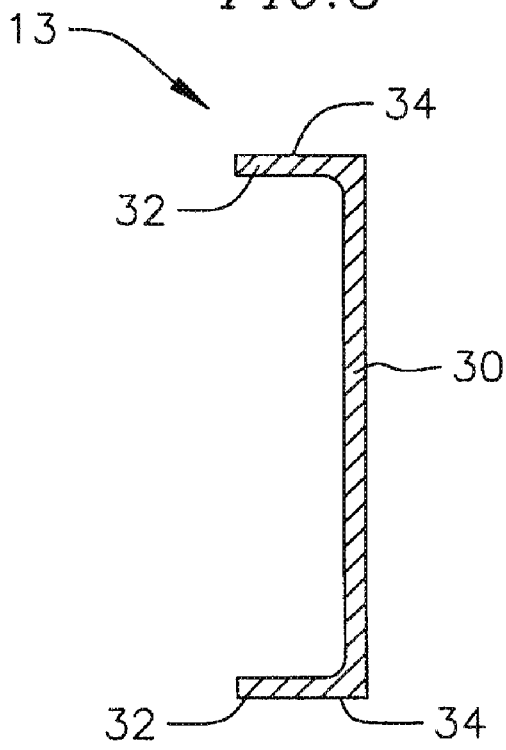
FIG. 3 is a sectional view of a panel spacer of the modular building structure of FIG. 1.

With reference to FIG. 3, a panel spacer 13, according to one embodiment, has an elongated C-shaped channel structure. Each panel spacer 13 includes a web 30 and two flanges 32 at opposite ends of the web 30. Each of the two flanges 32 is substantially perpendicular to the web 30. Further, each of the two flanges 32 has an outer surface 34, wherein the outer surfaces 34 of the two flanges 32 are substantially parallel to each other. A distance between the two outer surfaces 34 is such that each of the panel spacers 13 is configured to be received between the two outer skins 20 of an edge of a panel 12 with each of the outer surfaces 34 of the panel spacer 13 adjacent the inner surfaces 22 of the two outer skins 20. The panel spacer may further act to hold the outer skins spaced from one another within a panel connector 14. The panel spacer 13, in one embodiment, is formed of aluminum. Alternatively, the panel spacers 13 may be formed of any other suitable metal, plastic, fiberglass, or similar material. Further, the panel spacers 13 may be formed by an extruding process since a perimeter of a cross-section of one of the panel spacers 13 is constant along the entire length of the panel spacer 13. The web 30 and the flanges 32 may have any suitable thicknesses, and may differ in various embodiments (see, e.g., FIGS. 1 and 9).

Figure 4A:
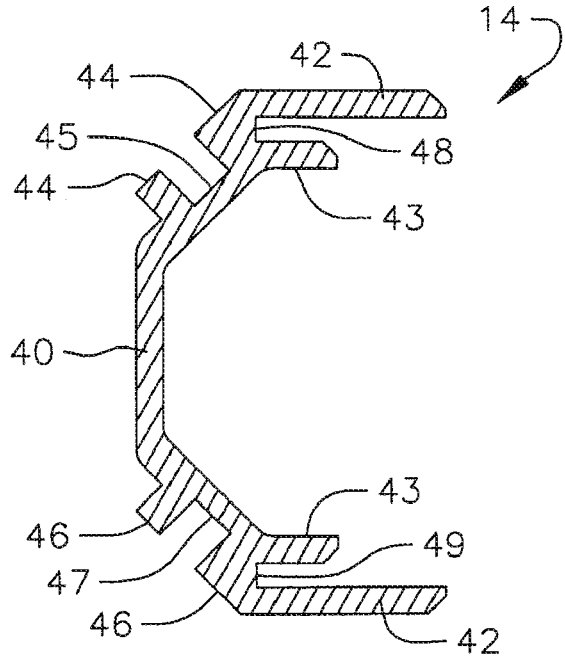
FIG. 4A is a sectional view of a panel connector of the modular building structure of FIG. 1.

With reference to FIG. 4A, each of the panel connectors 14, according to one embodiment, is an elongated member having a web 40 and two outer arms 42 extending from the web 40. Each of the two outer arms 42 is substantially perpendicular to the web 40. Also, the two outer arms 42 are substantially parallel to each other. The panel connector 14, in one embodiment, also includes two inner arms 43 extending from the web 40. Each of the two inner arms 43 is substantially perpendicular to the web 40 and adjacent and substantially parallel to one of the outer arms 42. The panel connectors 14, according to one embodiment, also include a first abutting surface 44 between and connected to the web 40 and one of the outer arms 42. The first abutting surface 44 may be oriented at an angle of approximately 45 degrees relative to the web 40. Further, there is a first groove 45 in and generally perpendicular to the first abutting surface 44 extending along a length of the panel connector 14. The panel connector 14 also includes a second abutting surface 46 between and connected to the web 40 and the other of the two outer arms 42. The second abutting surface 46 may be oriented at an angle of approximately 45 degrees relative to the web and substantially perpendicular to the first abutting surface 44. Similar to the first groove 45 in the first abutting surface 44, there is a second groove 47 in the second abutting surface 46.

The panel connector 14, according to one embodiment, further includes a first slot 48 between one of the two outer arms 42 and an adjacent inner arm 43. The first slot 48 may extend along the length of the panel connector 14 and is configured to receive one of the two flanges 32 of one of the panel spacers 13 when fitted to a panel 12, such that the outer surface 34 of the flange 32 is adjacent the outer skin 20 of the panel 12. The panel connector 14 further includes a second slot 49 similar to the first slot 48, but between the other of the two outer arms 42 and the other inner arm 43. The second slot 49 is configured to receive the other of two flanges 32 of the panel spacer 13, in a similar manner as described above with respect to the first slot 48.

Figure 4B:
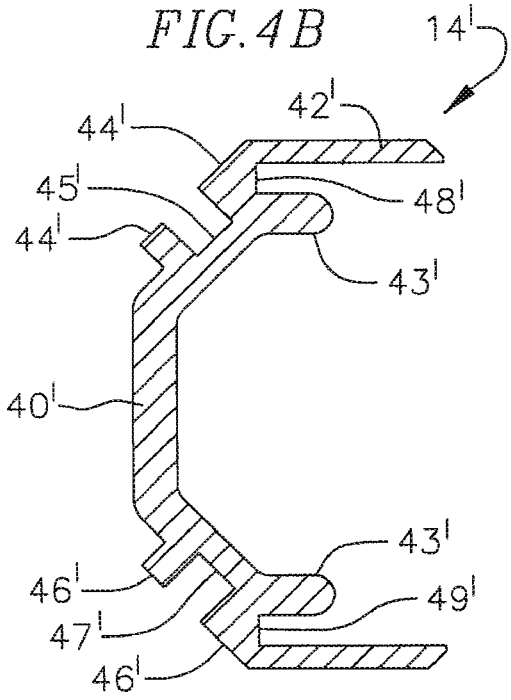
FIG. 4B is a sectional view of a panel connector according to another embodiment.

With reference to FIG. 4B, a panel connector 14' according to another embodiment is similar to the panel connector 14 described above and shown in FIG. 4A, but the panel connector 14' includes a web 40' having a greater thickness than the web 40 of the panel connector 14 for increased strength and rigidity. Further, the panel connector 14' has inner arms 43' that are thicker than those of the previous embodiment. Additionally, each of the inner arms 43' includes a rounded end for more closely fitting adjacent a radius between the web 30 and the flange 32 of the panel spacer 13. Many other features of the previous embodiment are included in this panel connector, for example, a pair of outer arms 42' are included, as are first and second abutting surfaces 44', 46', first and second grooves 45', 47', and first and second slots 48', 49'.

Figure 4C:
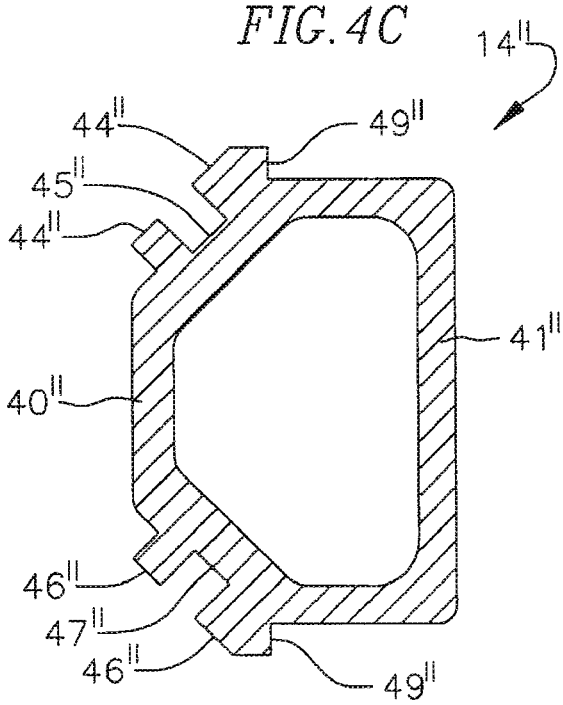
FIG. 4C is a sectional view of a panel connector according to another embodiment.
Figure 19:
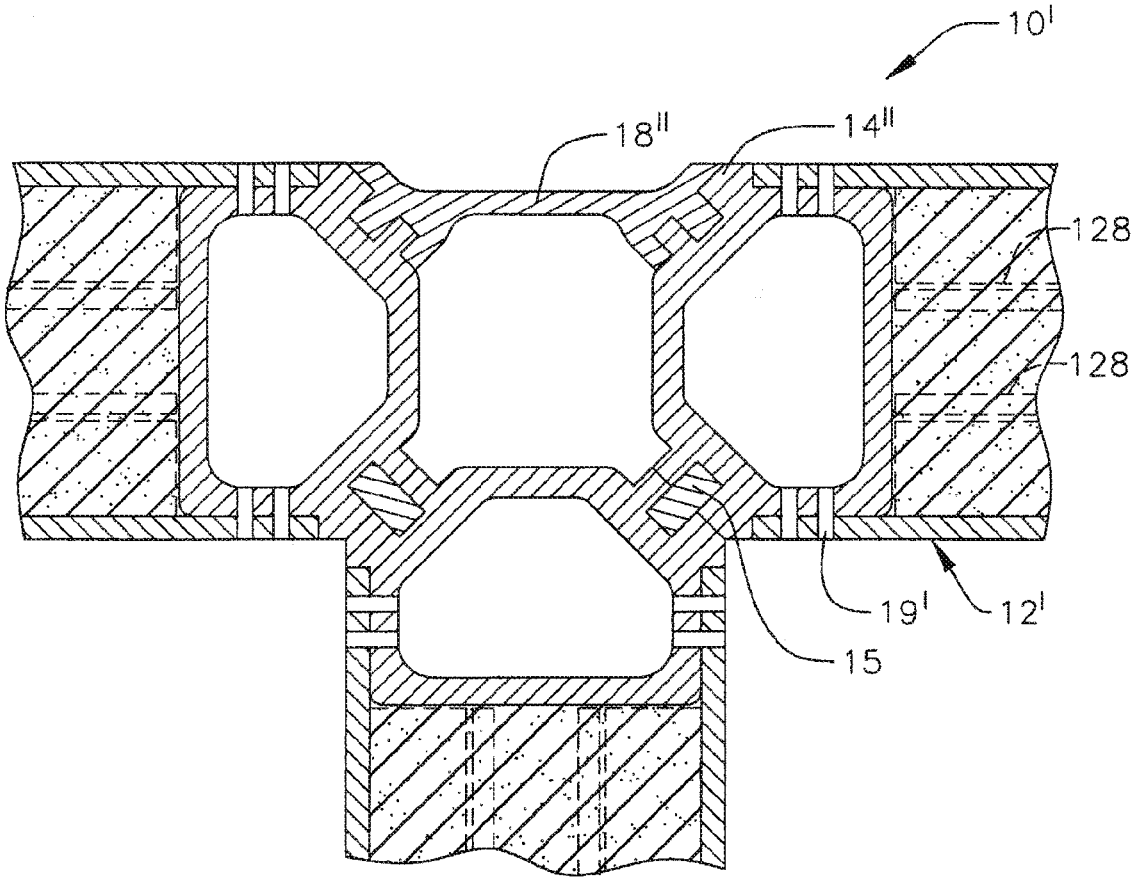
FIG. 19 is a sectional view of assembled components of a modular building structure according to another embodiment of the present invention.
Figure 20:
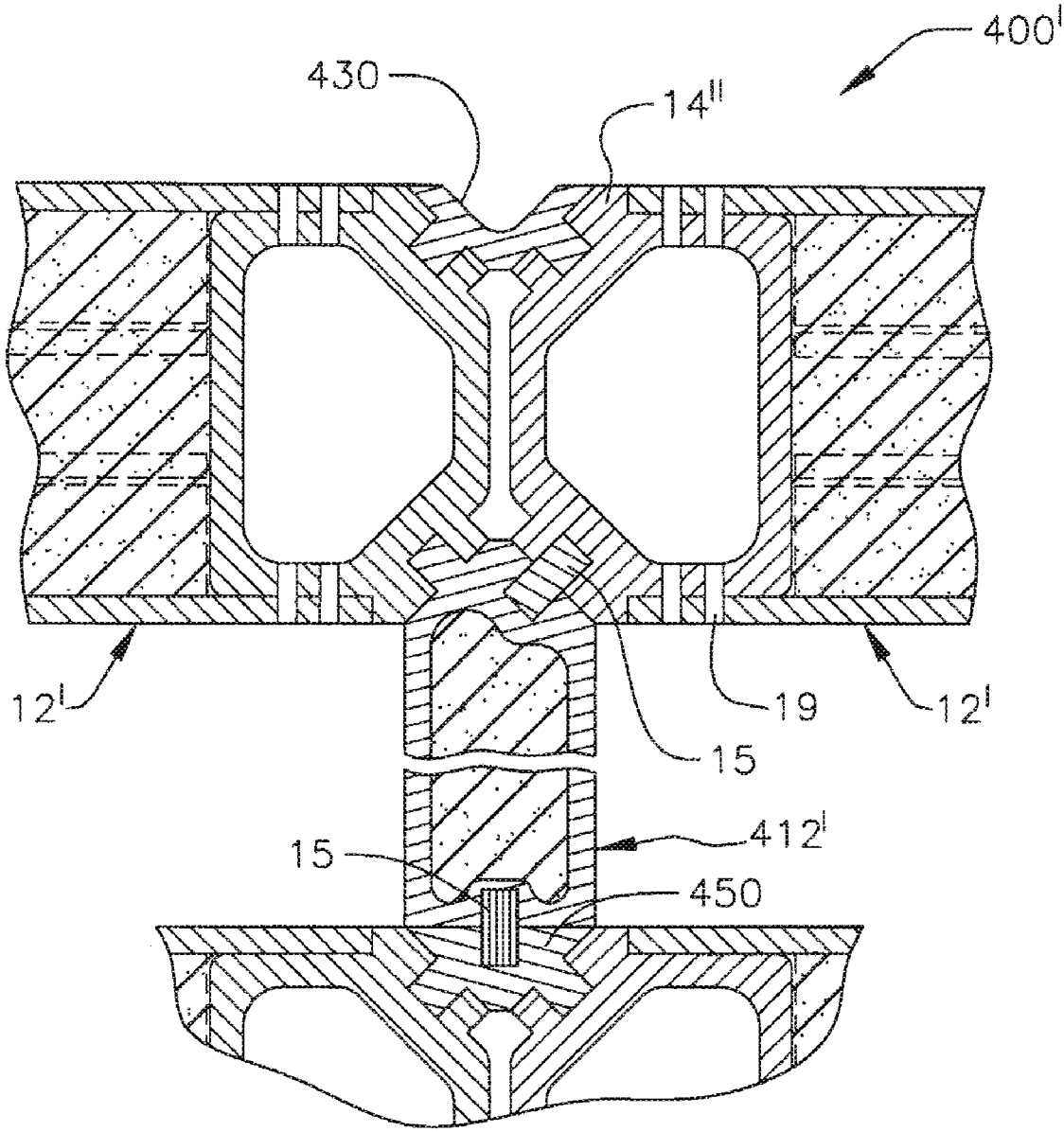
FIG. 20 is a sectional view of assembled components of a modular building structure according to another embodiment of the present invention.

With reference to FIG. 4C, a panel connector 14" according to another embodiment substantially combines the structure and the function of a previously discussed panel connector 14 and a panel spacer 13. That is, embodiments of a modular building structure including the panel connector 14" do not include the panel spacer 13. As shown in FIG. 4C, the panel connector 14" has a web 40" which is similar to the web 40 of the panel connector 14, but which also substantially incorporates and combines the outer and inner arms 42, 43 of the panel connector 14 on second and third sides, and further includes a fourth side 41" having a structure similar to the panel spacer 13 but being integrally formed with the web 40" rather than being a separate component. Further, the web 40" has a greater thickness than the web 40 of the panel connector 14 for increased strength and rigidity. Also, because the panel connector 14" does not include the outer and inner arms 42, 43 and the first and second slots 48, 49 therebetween for receiving the outer skins 20 of the panel 12, the panel connector 14" instead has a step 49" on each of the second and third sides of the web 40". The panel connector 14" is configured such that the inner core 26 of the panel 12 abuts an outer surface of the fourth side 41" of the web 40" and ends of the outer skins 20 of the panel 12 abut the steps 49", outer surfaces of the second and third sides of the web 40" closely contacting inner surfaces of the outer skins 20 of the panel 12, as shown in FIGS. 19 and 20, for example. Further, the panel connector 14" is configured to be used on cut edges of the panel 12' described below (see FIG. 19, for example). The panel connector further includes first and second abutting surfaces 44", 46", and first and second grooves 45', 47', are described above in other embodiments.

Embodiments of the panel connectors 14, 14', 14" may be formed of aluminum. Alternatively, the panel connectors 14, 14', 14" may be formed of any other suitable metal, plastic, fiberglass, or other material. Further, the panel connectors 14, 14', 14" may be formed by an extruding process since a perimeter of a cross-section of one of the panel connectors 14, 14', 14" is constant along the entire length of the panel connector 14, 14', 14".

Figure 5:
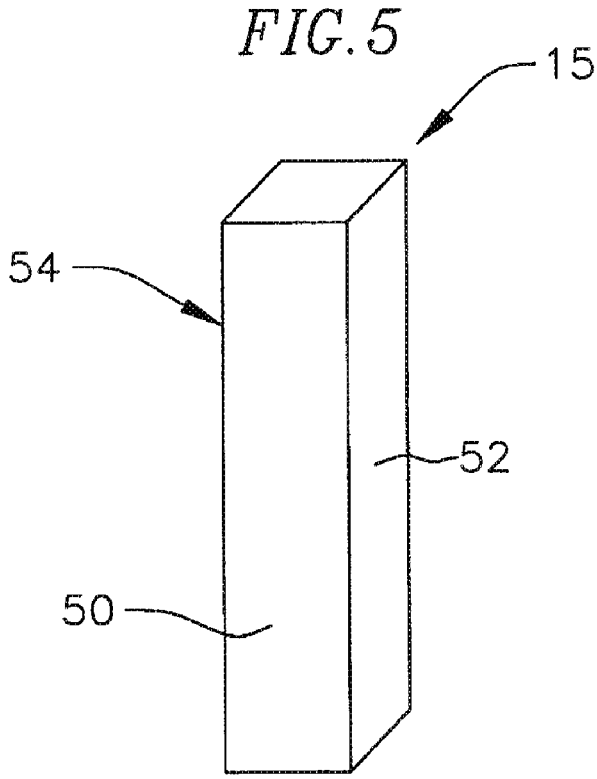
FIG. 5 is a perspective view of a coupling bar of the modular building structure of FIG. 1.

With reference to FIG. 5, each coupling bar 15, according to one embodiment, is an elongated bar 50 having a first surface 52 extending along a length of the coupling bar 15 and a 15 second surface 54 substantially parallel to the first surface 52 and also extending along the length of the coupling bar 15. The coupling bars 15 are configured to be partially received (i.e., a portion of the coupling bar 15 including the first surface 52) by one of the first and second grooves 45, 47 of one of the panel connectors 14 and also partially received (i.e., a portion of the coupling bar 15 including the second surface 54) by one of the first and second grooves 45, 47 of another of the panel connectors 14. Further, as shown in FIG. 1, when a pair of panels including panel connectors are arranged adjacent and perpendicular to one another, corresponding grooves 45 or 47 of the adjacent panel connectors together form a coupling channel in which the coupling bar 15 is received. By this arrangement, the coupling bar 15 constrains the panel connectors 14, and the connected panels 12, from moving with respect to one another. As such, a width of the first surface and a width of the second surface should be approximately equal, and of tight tolerances to be only slightly smaller than a width of the first groove 45 and/or a width of the second groove 47 of the panel connector 14.

The coupling bars 15, in one embodiment, are formed of aluminum. Alternatively, the coupling bars 15 may be formed of any other suitable metal, plastic, fiberglass, or other suitable material. Further, the coupling bars 15 may be formed by an extruding process since a perimeter of a cross-section of one of the coupling bars 15 is constant along the entire length of the coupling bar 15.

Figure 6A:
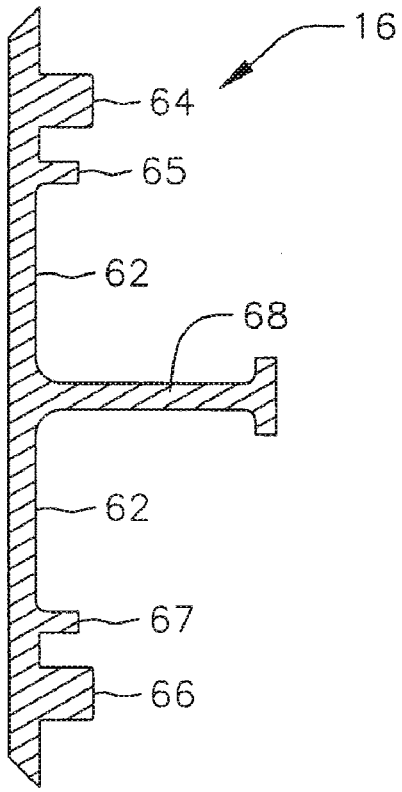
FIG. 6A is a sectional view of a corner coupler of the modular building structure of FIG. 1.

With reference to FIG. 6A, a corner coupler 16, according to one embodiment, is configured to couple the assembly with two panels 12 substantially perpendicular to each other. Each of the corner couplers 16 is an elongated member having an inward surface 62 extending along a length of the corner coupler 16. The corner couplers 16 include a first rib 64 protruding from the inward surface 62 and configured to be received by one of the first and second grooves 45, 47 of one of the panel connectors 14. The corner couplers 16, in one embodiment, include a second rib 65 protruding from the inward surface 62 near the first rib 64. A groove is formed between the first and second ribs 64, 65. A third rib 66, similar to the first rib 64, also protrudes from the inward surface 62 and is configured to be received by one of the first and second grooves 45, 47 of one the panel connectors 14. Further, a fourth rib 67, similar to the second rib 65, protrudes from the inward surface 62 near the third rib 66, forming a groove between the third and fourth ribs 66, 67. Also, in one embodiment, the corner coupler 16 includes a fifth rib 68 protruding from the inward surface 62 between the second and fourth ribs 65, 67.

Figure 6B:
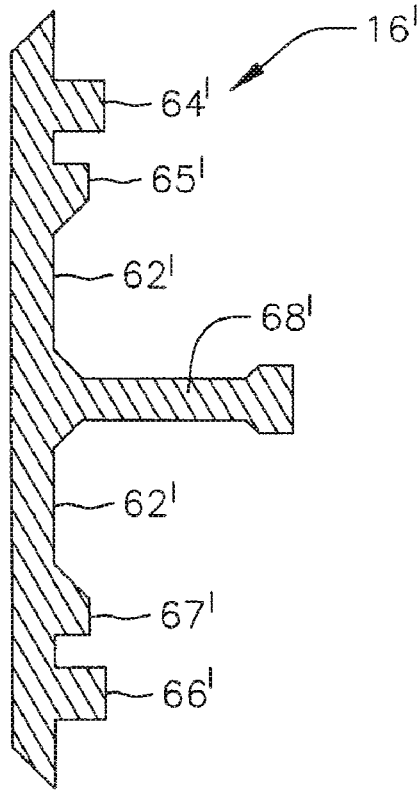
FIG. 6B is a sectional view of a corner coupler according to another embodiment.

With reference to FIG. 6B, a corner coupler 16' according to another embodiment is similar to the corner coupler 16 described above and shown in FIG. 6A, but the corner coupler 16' generally has a greater thickness than the corner coupler 16 for increased strength and rigidity. For example, as shown in FIG. 6B, the corner coupler 16' includes an inward surface 62' and first and third ribs 64', 66' as described previously. However, a fifth rib 68' is included, having a greater thickness than the fifth rib 68 of the previously described corner coupler 16. Further, the corner coupler 16' includes a second rib 65' and a fourth rib 67', each having a greater thickness than the respective second and fourth ribs 65, 67 of the previously described corner coupler 16, and additionally having a chamfered, or angled, intersection with the inward surface 62', rather than a radiused intersection.

Figure 6C:
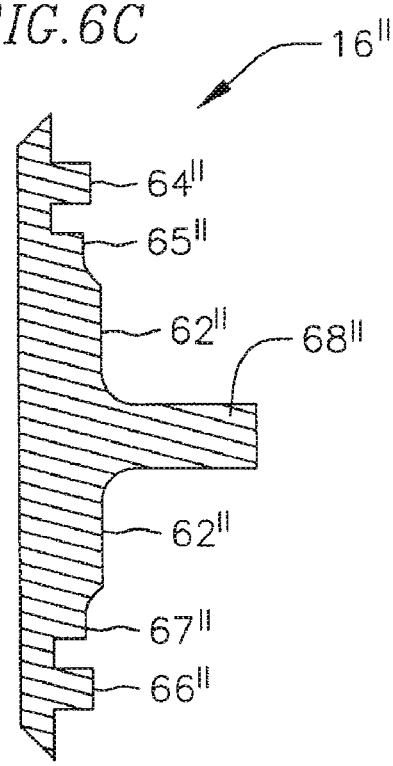
FIG. 6C is a sectional view of a corner coupler according to another embodiment.

With reference to FIG. 6C, another corner coupler 16" according to another embodiment is also similar to the corner coupler 16 described above and shown in FIG. 6A, but the corner coupler 16" generally has an even greater thickness than the previously described corner couplers for still further increased strength and rigidity. As shown in FIG. 6C, the corner coupler 16" includes a fifth rib 68" having a greater thickness than the fifth ribs previously described, and moreover, having a greater and constant thickness along an inward surface 62" an entire length of the fifth rib 68". Further, the corner coupler 16' includes a second rib 65" and a fourth rib 67", each of which essentially extends to the fifth rib 68". That is, the corner coupler 16" has an increased thickness along an entire portion between each of the second and fourth ribs 65", 67" and the fifth rib 68". Further, the inward surface 62" of the corner coupler 16" between each of the second and fourth ribs 65", 67" and the fifth rib 68" may extend past the second and fourth ribs 65", 67" such that a thickness of the corner coupler 16" in this region is greater than a thickness at the second and fourth ribs 65", 67". The corner coupler 16" further includes first and third ribs 64", 66" as previously described.

The corner coupler 16, 16', 16", in one embodiment, is formed of aluminum. Alternatively, the corner coupler 16, 16', 16" may be formed of any other suitable metal, plastic, fiberglass, or other suitable material. Further, the corner couplers 16, 16', 16" may be formed by an extruding process since a perimeter of a cross-section of one of the corner couplers 16, 16', 16" is constant along the entire length of the corner coupler 16, 16', 16".

To assemble the modular building structure 10, an assembly jig may be utilized to maintain the panels 12 at the required dimensions and at the proper orientation relative to each other. Also, fasteners, such as bolts, screws, rivets, pins or any other suitable fastening device, may be used to maintain the panels 12 in the correct position and orientation during assembly.

With further reference to FIG. 1, to assemble two panels 12 connected substantially perpendicular to each other, at least one corner coupler 16 is utilized and assembled with the other components as follows. One of the panel connectors 14 receives an edge of one of the panels 12, and another of the panel connectors 14 receives an edge of an adjacent and perpendicular panel 12. One of the coupling bars 15 is partially received within a coupling channel formed by adjacent first or second grooves 45, 47 of the two panel connectors 14. Also, one of the first and second abutting surfaces 44, 46 of one of the two panel connectors 14 abuts one of the first and second abutting surfaces 44, 46 of the other panel connector 14. The inward surface 62 of the corner coupler 16 abuts the other of the first and second abutting surfaces 44, 46 of one of the two panel connectors 14. Additionally, the first rib 64 of the corner coupler 16 is received by the other of the first and second grooves 45, 47 of one of the panel connectors 14. The inward surface 62 of the corner coupler 16 abuts the other of the first and second abutting surfaces 44, 46 of the other panel connector 14. The third rib 66 of the corner coupler 16 is received by the other of the first and second grooves 45, 47 of the other panel connector 14. The fifth rib 68 abuts each of the two panel connectors 14 near the coupling bar 15.

The panel connectors 14 are one portion of an integral locking system. Another portion of the integral locking system, also automatically assuring assembly alignment, is the coupling bar 15. The panel connectors 14 and the coupling bars 15 are made to close tolerances to ensure that as the modular building structure 10 is assembled, no undue stresses develop within the completed structure. This is very important because if the components are not properly oriented with respect to one another, assembly of more complex structures such as a six-sided box would be difficult, and perhaps impossible. The above-described components of the modular building structure 10, produced within the stated tolerances, would fit together rapidly and nearly effortlessly, well within the capabilities of semi-skilled workers. The assembly of a box, for example, can be easily achieved with a crew of three workers. Assembly begins by securely and precisely attaching the panels 12, the panel spacers 13, and the panel connectors 14 in a permanent fashion by inserting the two outer skins 20 of the panels 12 and the two flanges 32 of the panel spacers 13 in the first and second slots 48, 49 of the panel connectors 14.

Figure 7:
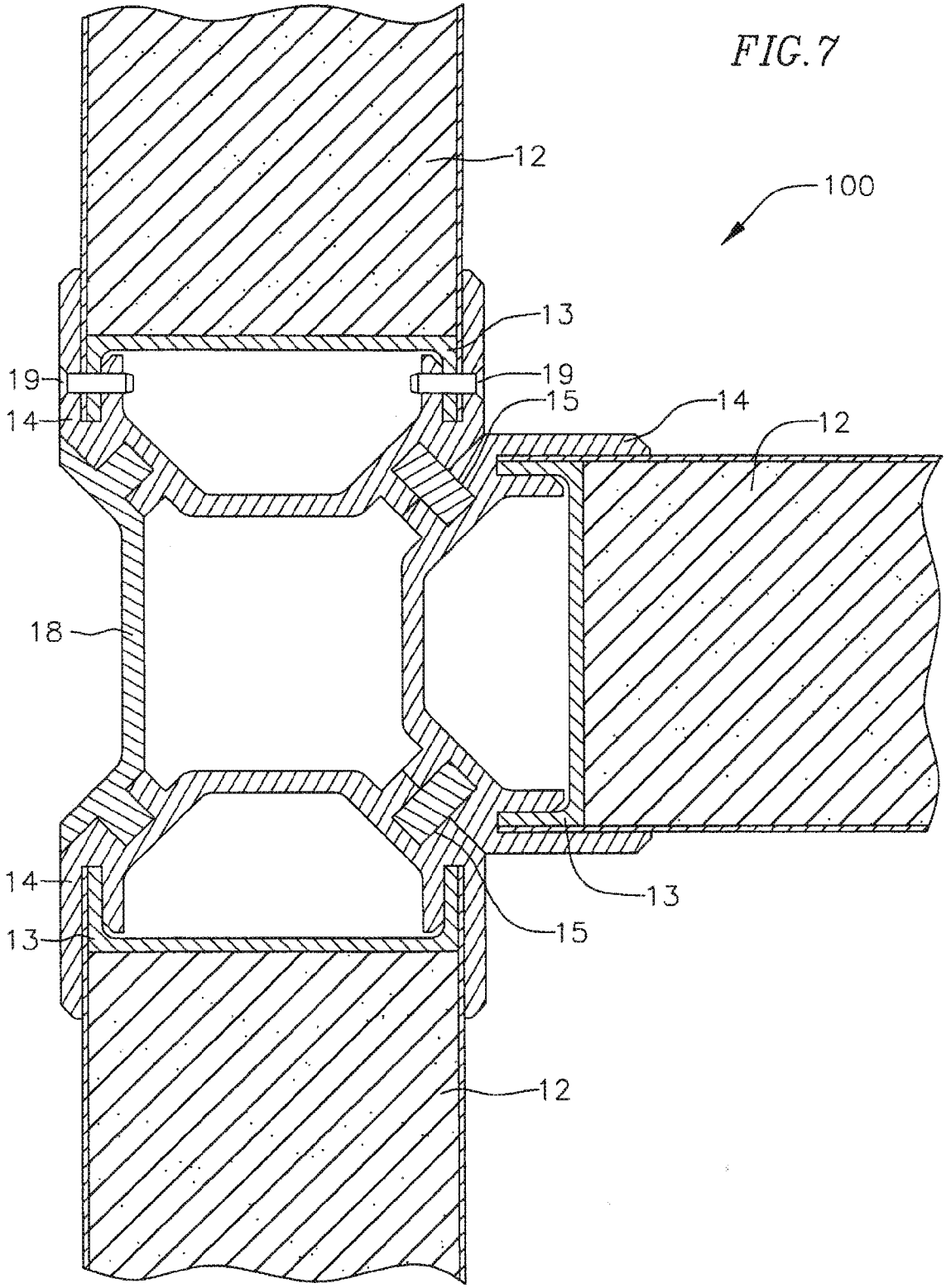
FIG. 7 is a sectional view of assembled components of a modular building structure according to another embodiment of the present invention.

FIG. 7 shows a sectional view of a portion of a modular building structure 100 according to another embodiment of the present invention. However, the modular building structure 100 shown in FIG. 7 may also be a portion of the modular building structure 10 described above and shown in FIG. 1. Moreover, the modular building structure 10 described above may be included in the modular building structure 100. Some components of the modular building structure 100 described below are given like reference numbers as the components described above with respect to the modular building structure 10 and are interchangeable.

Figure 8A:
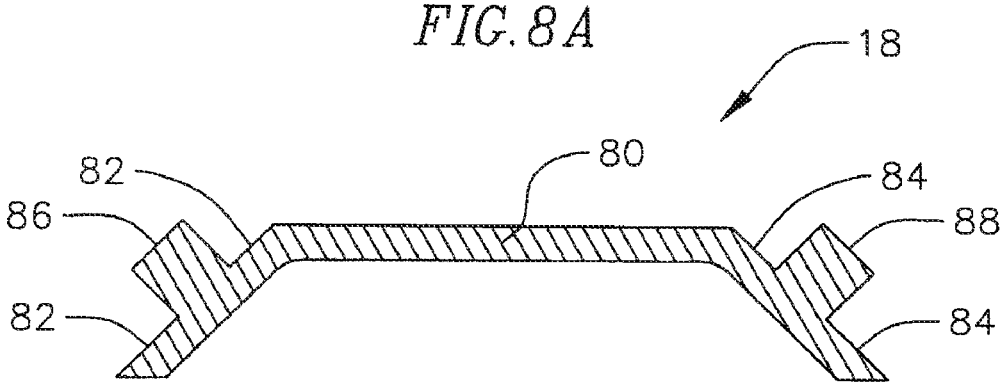
FIG. 8A is a sectional view of a straight coupler of the modular building structure of FIG. 7.

With reference to FIG. 7, the modular building structure 100 includes at least three panels 12, at least three panel spacers 13, at least three panel connectors 14, at least two coupling bars 15, and at least one edge coupler, which in one embodiment is a straight coupler 18 shown in FIG. 8A. Alternatively to one or more of the straight couplers 18, the modular building structure 100 may include at least one of the straight couplers 18', 18" respectively shown in FIGS. 8B and 8C.

With reference to FIG. 8A, the straight coupler 18, according to one embodiment, includes an elongated member having a web 80, a first abutting surface 82 connected to the web 80, and a second abutting surface 84 connected to the web 80. The web 80 and the first and second abutting surfaces 82, 84 extend along the length of the straight coupler 18. The first abutting surface 82, in one embodiment, is oriented at an angle of approximately 45 degrees relative to the web 80. Further, the second abutting surface 84 is oriented at an angle of approximately 45 degrees relative to the web 80 and is substantially perpendicular to the first abutting surface 82. The straight coupler 18 further includes a first rib 86 protruding from the first abutting surface 82. The first rib 86 is configured to be received by one of the first and second grooves 45, 47 of one of the panel connectors 14 and is dimensioned with tolerances to form a snug fit therein. Similarly, the straight coupler 18 further includes a second rib 88 protruding from the second abutting surface 84 and configured to be received by one of the first and second grooves 45, 47 of one of the panel connectors 14, as described above with respect to the first rib 86.

Figure 8B:
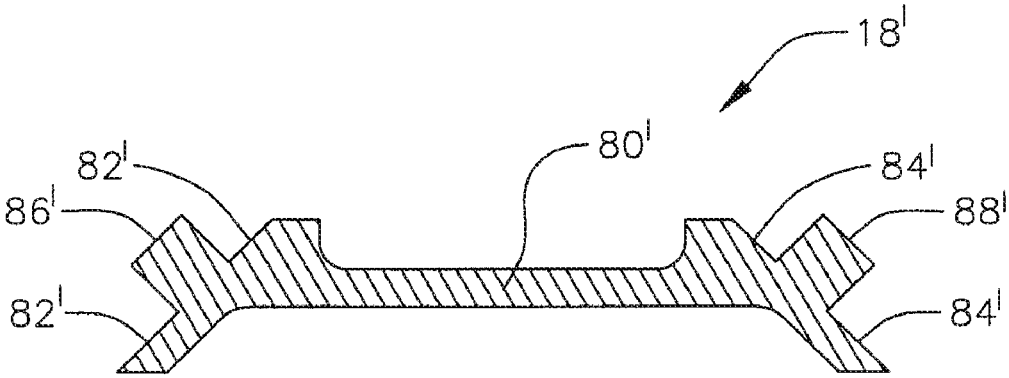
FIG. 8B is a sectional view of a straight coupler according to another embodiment.

With reference to FIG. 8B, the straight coupler 18' is an alternative embodiment of the straight coupler 18 described above and shown in FIG. 8A. The straight coupler 18' includes a web 80', the first and second abutting surfaces 82', 84', and the first and second ribs 86', 88', as described above with respect to the straight coupler 18. Moreover, the first and second ribs 86', 88' are configured to be received by one of the first and second grooves 45, 47 of one of the panel connectors 14, as described above with respect to the straight coupler 18. The straight coupler 18' differs from the straight coupler 18 in that the web 80' is located closer to a center plane of the straight coupler (see FIG. 8B), rather than being offset from a center plane, as is the web 80 shown in FIG. 8A.

Figure 8C:
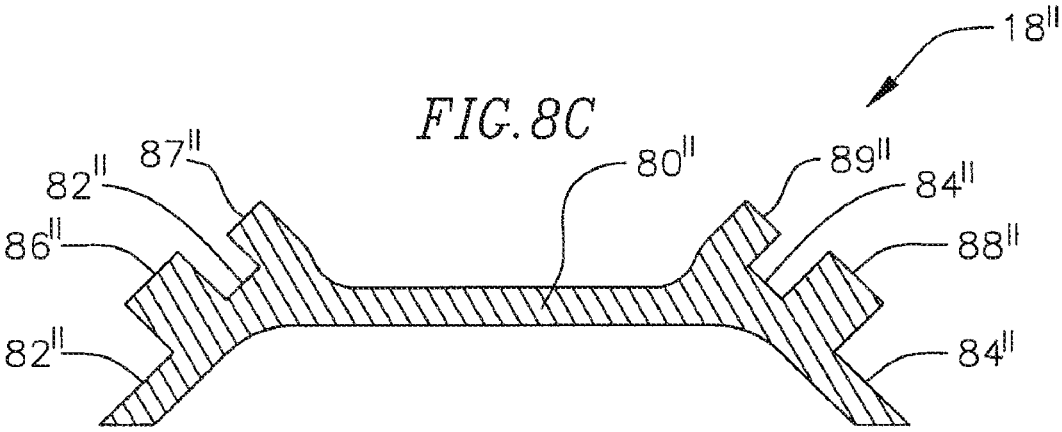
FIG. 8C is a sectional view of a straight coupler according to another embodiment.

With reference to FIG. 8C, the straight coupler 18" is another alternate embodiment of a straight coupler. The straight coupler 18" is similar to those described previously, and includes a web 80", first and second abutting surfaces 82", 84", and first and second ribs 86", 88", as described above. Moreover, the first and second ribs 86", 88" are configured to be received by one of the first and second grooves 45, 47 of one of the panel connectors 14. The straight coupler 18" further includes a third rib 87" proximate the first rib 86", and a fourth rib 89" proximate the second rib 88". The third and fourth ribs 87", 89" each extend in a same direction as the first and second ribs 86", 88", respectively, and are configured to abut a surface of the panel connector 14.

Each of the straight couplers 18, 18', 18", in one embodiment, is formed of aluminum. Alternatively, the straight couplers 18, 18', 18" may be formed of any other suitable metal, plastic, fiberglass, or other suitable material. Further, the straight couplers 18, 18', 18" may be formed by an extruding process since a perimeter of a cross-section of each of the straight couplers 18, 18', 18" may be constant along the entire length of the straight coupler 18, 18', 18".

With further reference to FIGS. 1 and 7, the modular building structures 10, 100 may further include a plurality of fasteners 19 for securing the panel spacers 13 and the panel connectors 14 relative to the panels 12. The fasteners 19 may be utilized to secure the above components during assembly to ensure that the proper dimensions and parallelism of the panels 12 relative to each other is maintained such that later-assembled components of the modular building structure 100 are properly aligned. For example, in one embodiment, the positions of the panels 12 are maintained within a tolerance of 0.020 inches (0.51 mm) or less. The fasteners 19, in one embodiment, may be rivets. Alternatively, the fasteners 19 may be any other suitable fastening devices. Also, the fasteners 19 are formed of a material providing suitable strength that would not cause a galvanic or otherwise self-destructive reaction between the secured components. In one embodiment, the fasteners 19 are spaced from each other by approximately 8 inches (20 cm). Alternatively, any other suitable distance between the fasteners 19 may be utilized.

Assembly of the modular building structure 100 may be accomplished according to the above description with respect to assembly of the modular building structure 10. Further, to assemble two panels 12 connected substantially parallel to each other, at least one straight coupler 18, 18', 18" is utilized and assembled with the other components as follows. With further reference to FIG. 7, one of the panel connectors 14 receives a portion of one of the panels 12, and another of the panel connectors 14 receives a portion of the other panel 12. The first abutting surface 82 of one of the straight couplers 18 abuts one of the first and second abutting surfaces 44, 46 of one of the panel connectors 14. The first rib 86 of the straight coupler 18 is received by one of the first and second grooves 45, 47 of the panel connector 14 abutting the first abutting surface 82. The second abutting surface 84 of the straight coupler 18 abuts one of the first and second abutting surfaces 44, 46 of the other panel connector 14. Also, the second rib 88 of the straight coupler 18 is received by one of the grooves 45, 47 of the other panel connector 14.

Figure 9:
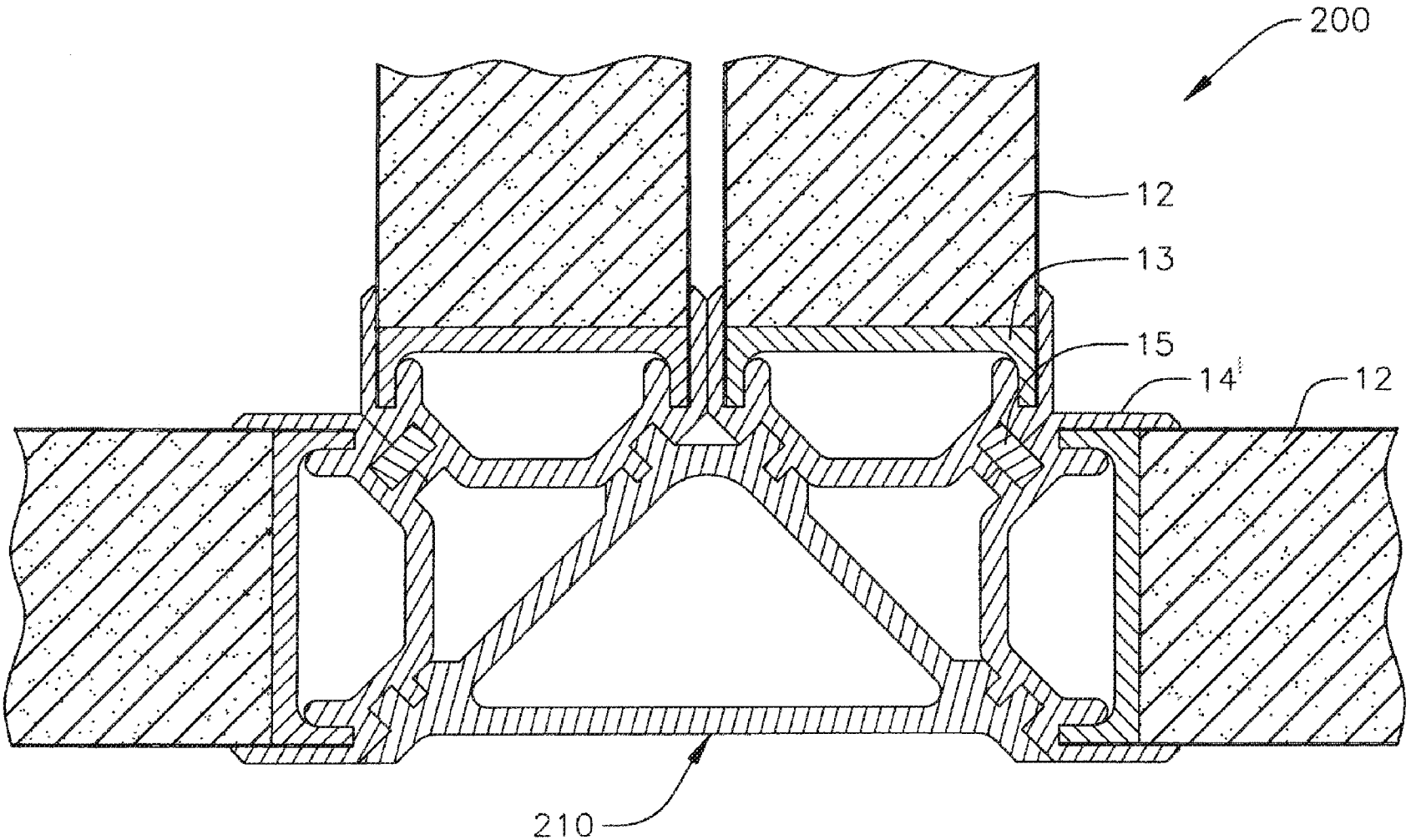
FIG. 9 is a sectional view of assembled components of a modular building structure according to another embodiment of the present invention.

FIG. 9 shows a sectional view of a portion of a modular building structure 200 according to another embodiment of the present invention. However, the modular building structure 200 shown in FIG. 9 may also be part of a same modular building structure 10 and/or 100 described above and shown in FIGS. 1 and 7. Some components of the modular building structure 200 described below are given like reference numbers as the components described above with respect to the modular building structures 10, 100 and are interchangeable.

With reference to FIG. 9, the modular building structure 200 is similar to the modular building structure 100 described above and shown in FIG. 7. However, the modular building structure 200 includes at least four panels 12, at least four corresponding panel spacers 13, at least four corresponding panel connectors 14, 14', at least two coupling bars 15, and at least one edge coupler, which in one embodiment is a straight coupler 210 shown in FIG. 10. As illustrated in FIG. 9, the modular building structure 200 couples two panels 12 end-to-end, and two parallel and adjacent panels 12 extending perpendicularly away from the intersection (i.e. in the form of a tee connection).

Figure 10:
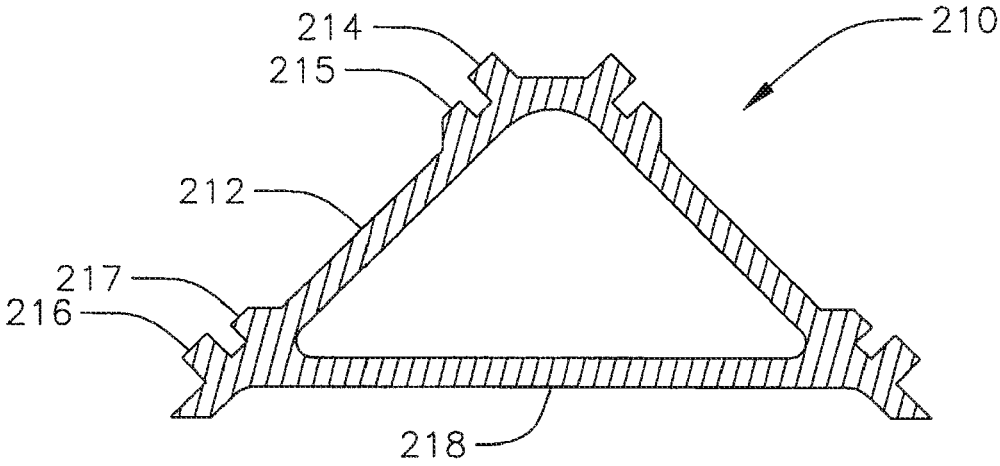
FIG. 10 is a sectional view of a straight coupler of the modular building structure of FIG. 9.

With reference to FIG. 10, the straight coupler 210, according to one embodiment, is configured to couple two pairs of panels 12 of the assembly together, each pair substantially perpendicular to each other. Essentially, the straight coupler 210 has a similar structure and function as two of the corner couplers 16 placed adjacent one another at 90 degrees from one another. As such, the straight coupler 210 has a substantially triangular cross section. The straight coupler 210 is an elongated member having an inward surface 212 extending along a length of the straight coupler 210. The straight coupler 210 includes a first rib 214 protruding from the inward surface 212 and configured to be received by one of the first and second grooves 45, 47 of one of the panel connectors 14, 14'. The straight coupler 210, in one embodiment, includes a second rib 215 protruding from the inward surface 212 near the first rib 214. A groove is formed between the first and second ribs 214, 215. A third rib 216, similar to the first rib 214, also protrudes from the inward surface 212 and is configured to be received by one of the first and second grooves 45, 47 of another one the panel connectors 14, 14'. Further, a fourth rib 217, similar to the second rib 215, protrudes from the inward surface 212 near the third rib 216, forming a groove between the third and fourth ribs 216, 217. Another side of the triangular shaped straight coupler 210 has a substantially identical structure for coupling two additional panels 12 via panel connectors 14, 14'. The third side of the triangular shaped straight coupler 210, in one embodiment, is a straight elongated portion 218 completing the triangle shape. The straight coupler 210, in one embodiment, is formed of aluminum. Alternatively, the straight coupler 210 may be formed of any other suitable metal, plastic, fiberglass, or other suitable material. Further, the straight coupler 210 may be formed by an extruding process since a perimeter of a cross-section of the straight coupler 210 may be constant along the entire length of the straight coupler 210.

Figure 11:
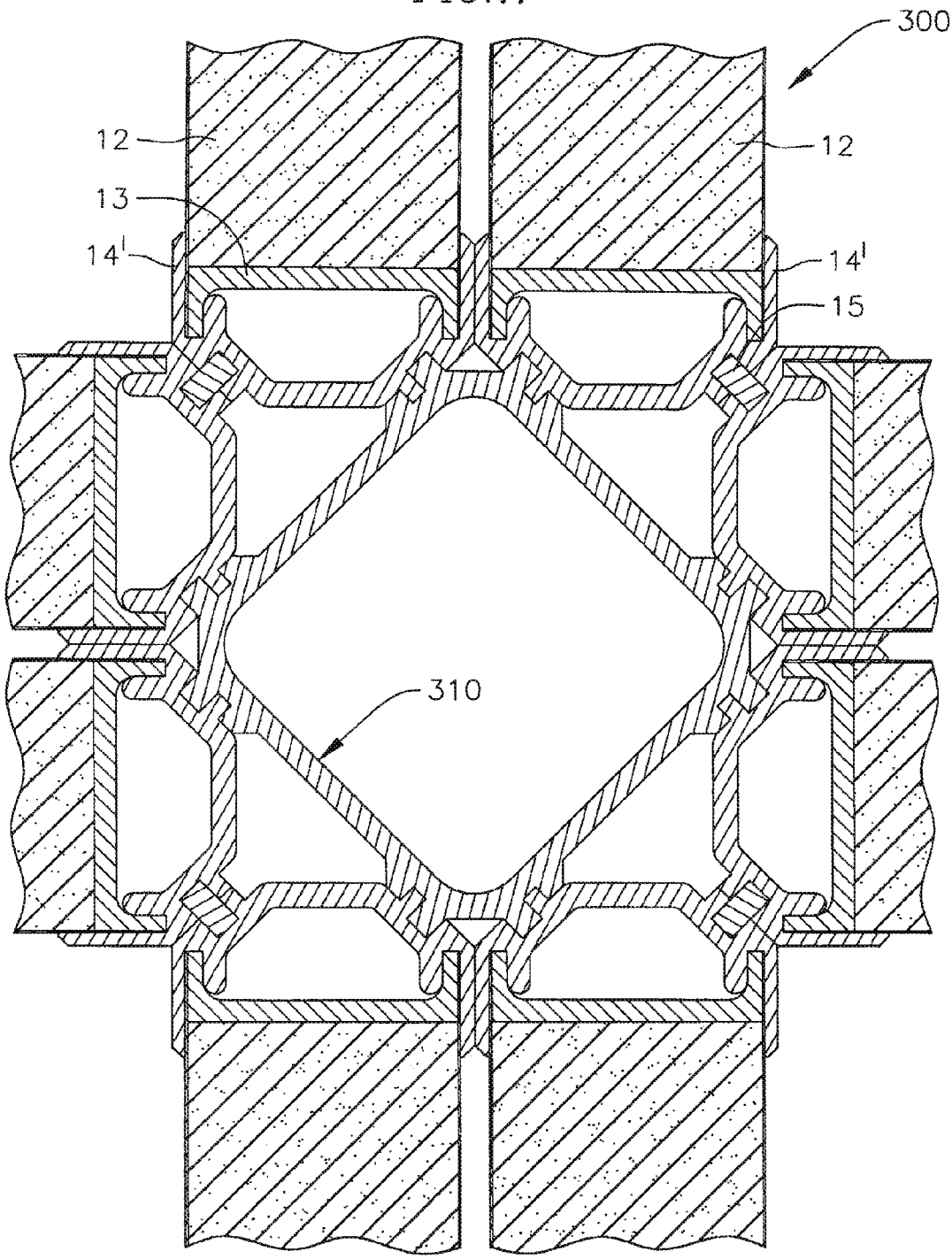
FIG. 11 is a sectional view of assembled components of a modular building structure according to another embodiment of the present invention.

FIG. 11 shows a sectional view of a portion of a modular building structure 300 according to another embodiment of the present invention. However, the modular building structure 300 shown in FIG. 11 may also be part of a same modular building structure 10, 100, and/or 200 described above and shown in FIGS. 1, 7, and 9. Some components of the modular building structure 300 described below are given like reference numbers as the components described above with respect to the modular building structures 10, 100, 200 and are interchangeable.

With reference to FIG. 11, the modular building structure 300 is similar to the modular building structure 200 described above and shown in FIG. 9. However, the modular building structure 300 includes eight panels 12, eight corresponding panel spacers 13, eight corresponding panel connectors 14, 14', four coupling bars 15, and one coupler, which in one embodiment is a cross coupler 310 shown in FIG. 12. As illustrated in FIG. 11, the modular building structure 300 couples eight panels 12 at a cross-shaped intersection, two parallel and adjacent panels 12 extending away from the intersection in directions 90 degrees from one another.

Figure 12:
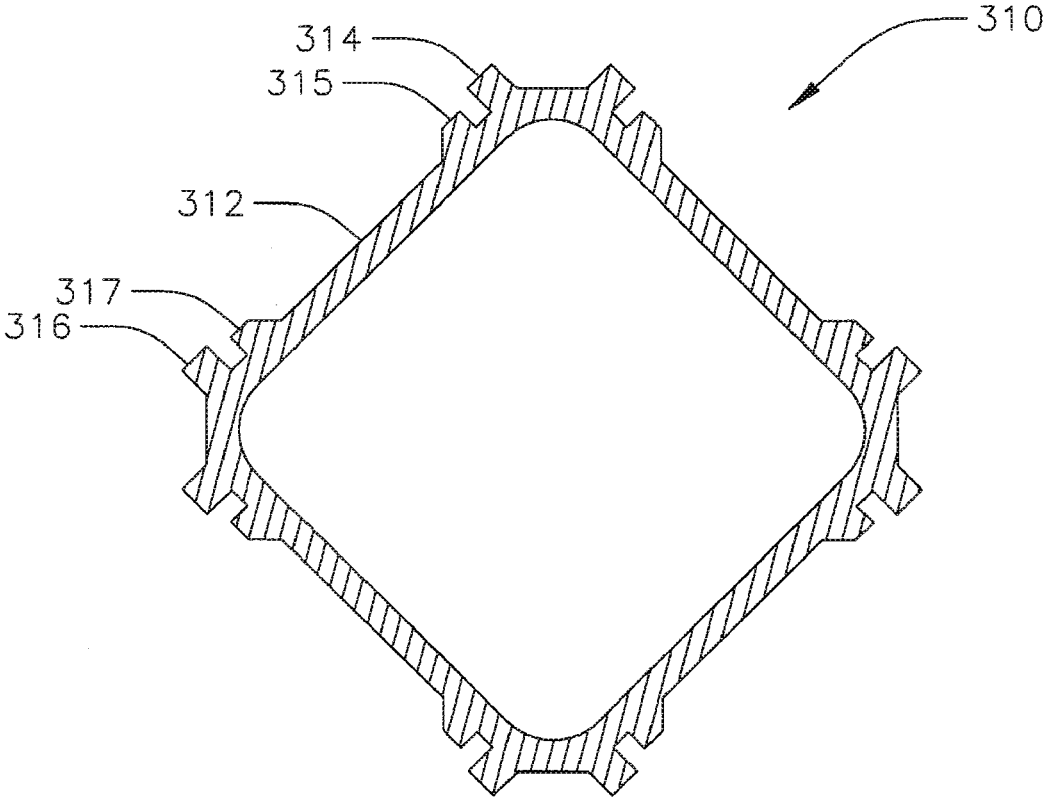
FIG. 12 is a sectional view of a cross coupler of the modular building structure of FIG. 11.

With reference to FIG. 12, the cross coupler 310, according to one embodiment, is configured to couple four pairs of panels 12, each pair substantially perpendicular to an adjacent pair. Essentially, the cross coupler 310 has a similar structure and function as four of the corner couplers 16 placed adjacent one another at 90 degrees from one another, or alternatively, two of the straight couplers 210 described above. As such, the cross coupler 310 has a substantially square cross section.

The cross coupler 310 is an elongated member having an outward surface 312 extending along a length of the cross coupler 310. The cross coupler 310 includes a first rib 314 protruding from the outward surface 312 and configured to be received by one of the first and second grooves 45, 47 of one of the panel connectors 14, 14'. The cross coupler 310, in one embodiment, includes a second rib 315 protruding from the outward surface 312 near the first rib 314. A groove is formed between the first and second ribs 314, 315. A third rib 316, similar to the first rib 314, also protrudes from the outward surface 312 and is configured to be received by one of the first and second grooves 45, 47 of another one the panel connectors 14, 14'. Further, a fourth rib 317, similar to the second rib 315, protrudes from the outward surface 312 near the third rib 316, forming a groove between the third and fourth ribs 316, 317. Each of the other three sides of the square shaped straight coupler 310 has a substantially identical structure for coupling two additional panels 12 via panel connectors 14, 14'. The cross coupler 310, in one embodiment, is formed of aluminum. Alternatively, the cross coupler 310 may be formed of any other suitable metal, plastic, fiberglass, or other suitable material. Further, the cross coupler 310 may be formed by an extruding process since a perimeter of a cross-section of the cross coupler 310 may be constant along the entire length of the cross coupler 310.

Figure 13:
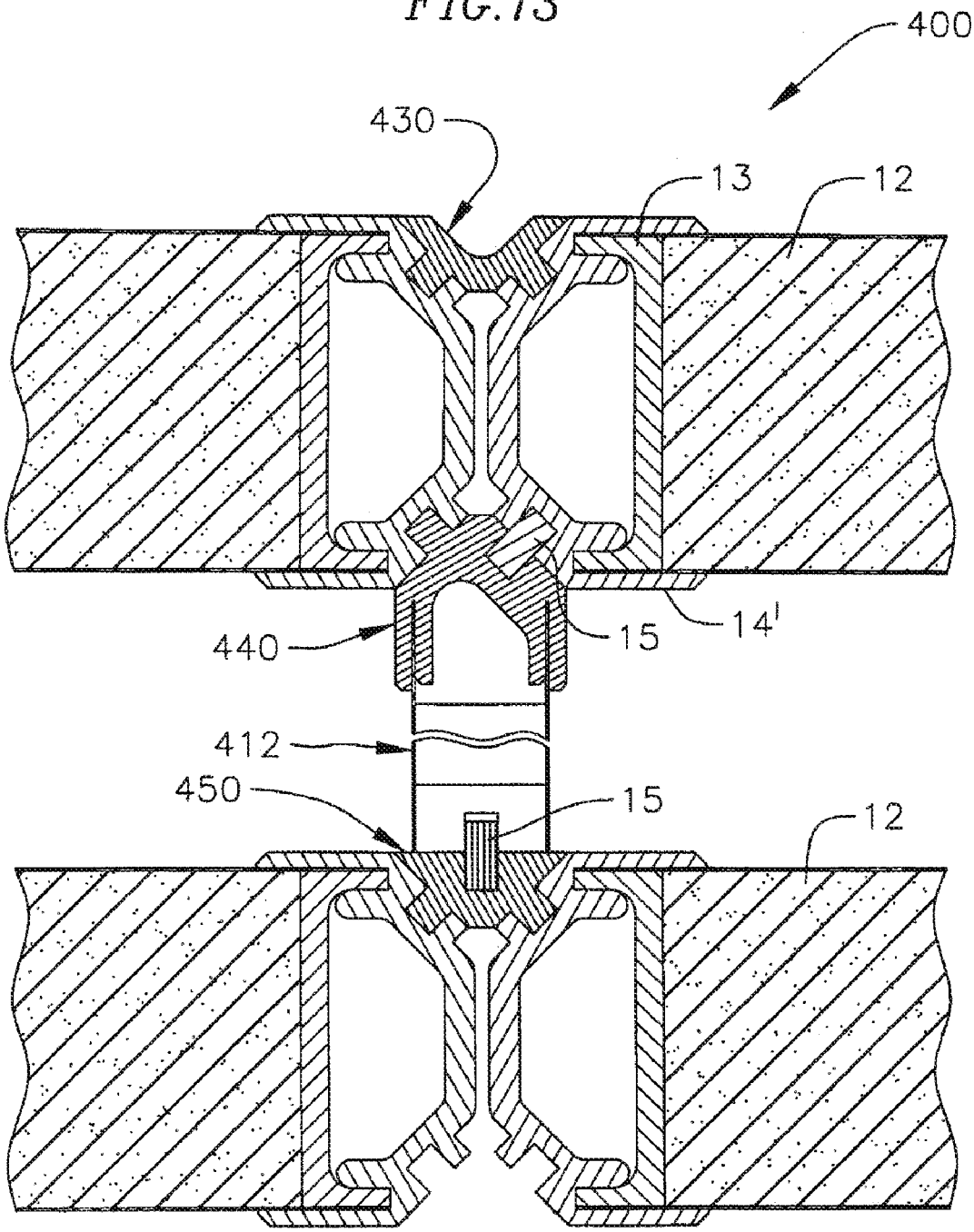
FIG. 13 is a sectional view of assembled components of a modular building structure according to another embodiment of the present invention.

FIG. 13 shows a sectional view of a portion of a modular building structure 400 according to another embodiment of the present invention. However, the modular building structure 400 shown in FIG. 13 may also be part of a same modular building structure 10, 100, 200, and/or 300 described above and shown in FIGS. 1, 7, 9, and 11. Some components of the modular building structure 400 described below are given like reference numbers as the components described above with respect to the modular building structures 10, 100, 200, 300 and are interchangeable.

With reference to FIG. 13, the modular building structure 400 is similar to the modular building structure 100 described above and shown in FIG. 7. However, a thin panel 412 extending from a tee-shaped intersection of three panels is provided such as might be used for a thin internal partition wall. The two other panels coupled end-to-end at the intersection may be two of the panels 12, described above, with the thin panel 412 substantially perpendicular to the panels 12. Also, as shown in FIG. 13, the modular building structure 400, in one embodiment, may include another tee-shaped intersection at which an opposite end of the thin panel 412 is coupled substantially perpendicularly to two other panels 12 that are coupled end-to-end via a tee coupler 440 or 450. The thin panel 412 may have a thickness, in one embodiment, of approximately 1 inch. Also, as a result of the thin panel 412 being thinner than other panels, the straight coupler 430 is shorter than the straight couplers 18, 18', 18" described above.

Figure 14:
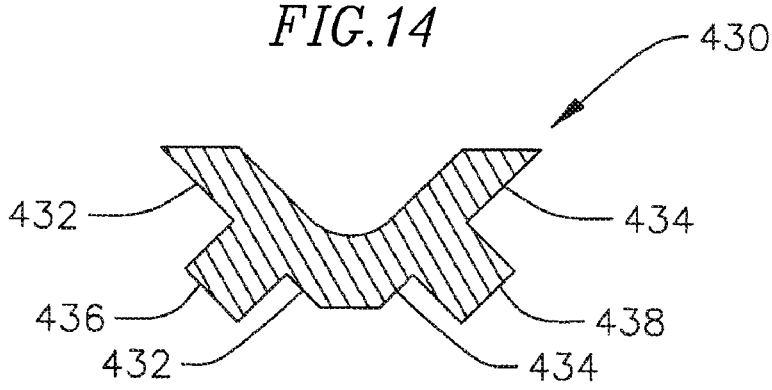
FIG. 14 is a sectional view of a straight coupler of the modular building structure of FIG. 13.

With reference to FIG. 14, the straight coupler 430, according to one embodiment, includes an elongated member having a first abutting surface 432 and a second abutting surface 434. The first abutting surface 432, in one embodiment, is oriented at an angle of approximately 90 degrees relative to the second abutting surface 434. The straight coupler 430 further includes a first rib 436 protruding from the first abutting surface 432. The first rib 436 is configured to be received by one of the first and second grooves 45, 47 of one of the panel connectors 14, 14' and is dimensioned with tolerances to form a snug fit therein. Similarly, the straight coupler 430 further includes a second rib 438 protruding from the second abutting surface 434 and configured to be received by one of the first and second grooves 45, 47 of another one of the panel connectors 14, 14', as described above with respect to the first rib 436. The straight coupler 430, in one embodiment, is formed of aluminum. Alternatively, the straight coupler 430 may be formed of any other suitable metal, plastic, fiberglass, or other suitable material. Further, the straight coupler 430 may be formed by an extruding process since a perimeter of a cross-section of the straight coupler 430 may be constant along the entire length of the straight coupler 430.

Figure 15:
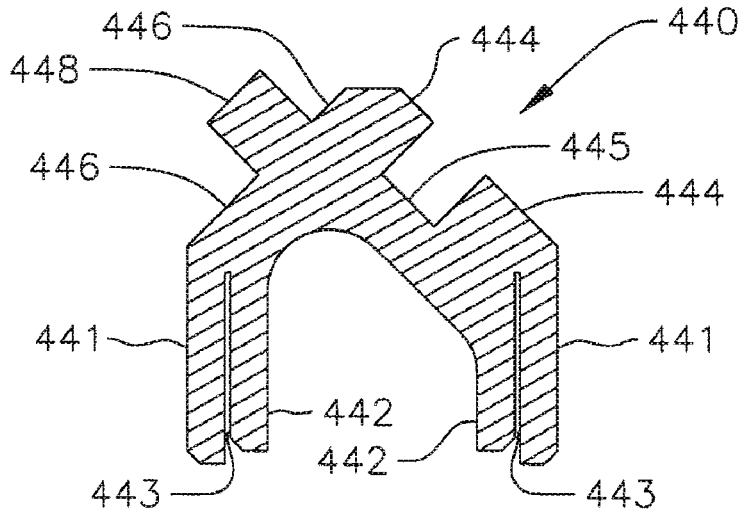
FIG. 15 is a sectional view of a tee coupler of the modular building structure of FIG. 13.

With reference to FIGS. 13 and 15, the tee coupler 440, according to one embodiment, is configured to couple the two panels connectors 14' of the modular building structure 400 linking a pair of panels 12 in a coplanar, end-to-end configuration and also couple the thin panel 412 between and substantially perpendicular to the two panels 12. As such, the tee coupler includes an elongated member having two substantially parallel outer arms 441 and two inner arms 442, each proximate and substantially parallel to one of the outer arms 441 and substantially parallel to each other. Between each pair of one of the outer arms 441 and the adjacent inner arm 442 is formed an elongated slot 443 configured to receive and support an outer skin of the panel 412. Further, the tee coupler 440, at an end opposite the outer and inner arms 441, 442, includes a first abutting surface 444, a second abutting surface 446, a groove 445 formed in the first abutting surface 444, and a rib 448 protruding from the second abutting surface 446. The groove 445 is configured for receiving one of the coupling bars 15 therein for coupling to one of the panel connectors 14, 14', and the rib 448 is configured to be received by one of the first and second grooves 45, 47 of another one of the panel connectors 14, 14'. The tee coupler 440, in one embodiment, is formed of aluminum. Alternatively, the tee coupler 440 may be formed of any other suitable metal, plastic, fiberglass, or other suitable material. Further, the tee coupler 440 may be formed by an extruding process since a perimeter of a cross-section of the tee coupler 440 may be constant along the entire length of the tee coupler 440.

Figure 16:
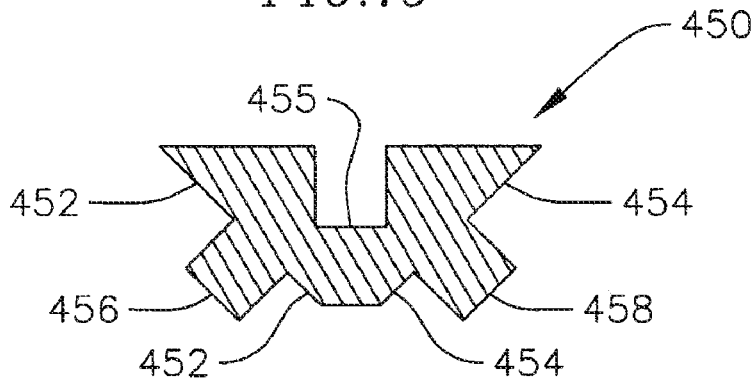
FIG. 16 is a sectional view of another embodiment of a tee coupler of the modular building structure of FIG. 13.

With reference to FIG. 16, the tee coupler 450, according to one embodiment, is substantially similar to the straight coupler described above and shown in FIG. 14. As such, the tee coupler 450 includes an elongated member having a first abutting surface 452, a second abutting surface 454, a first rib 456 protruding from the first abutting surface 452 and configured to be received by one of the first and second grooves 45, 47 of one of the panel connectors 14, 14', and a second rib 458 protruding from the second abutting surface 454 and configured to be received by one of the first and second grooves 45, 47 of another one of the panel connectors 14, 14'. The tee coupler further includes a groove 455 for receiving one of the coupling bars 15 therein for coupling to an end of the panel 412. The tee coupler 450, in one embodiment, is formed of aluminum. Alternatively, the tee coupler 450 may be formed of any other suitable metal, plastic, fiberglass, or other suitable material. Further, the tee coupler 450 may be formed by an extruding process since a perimeter of a cross-section of the tee coupler 450 may be constant along the entire length of the tee coupler 450.

Figures 17, 18:
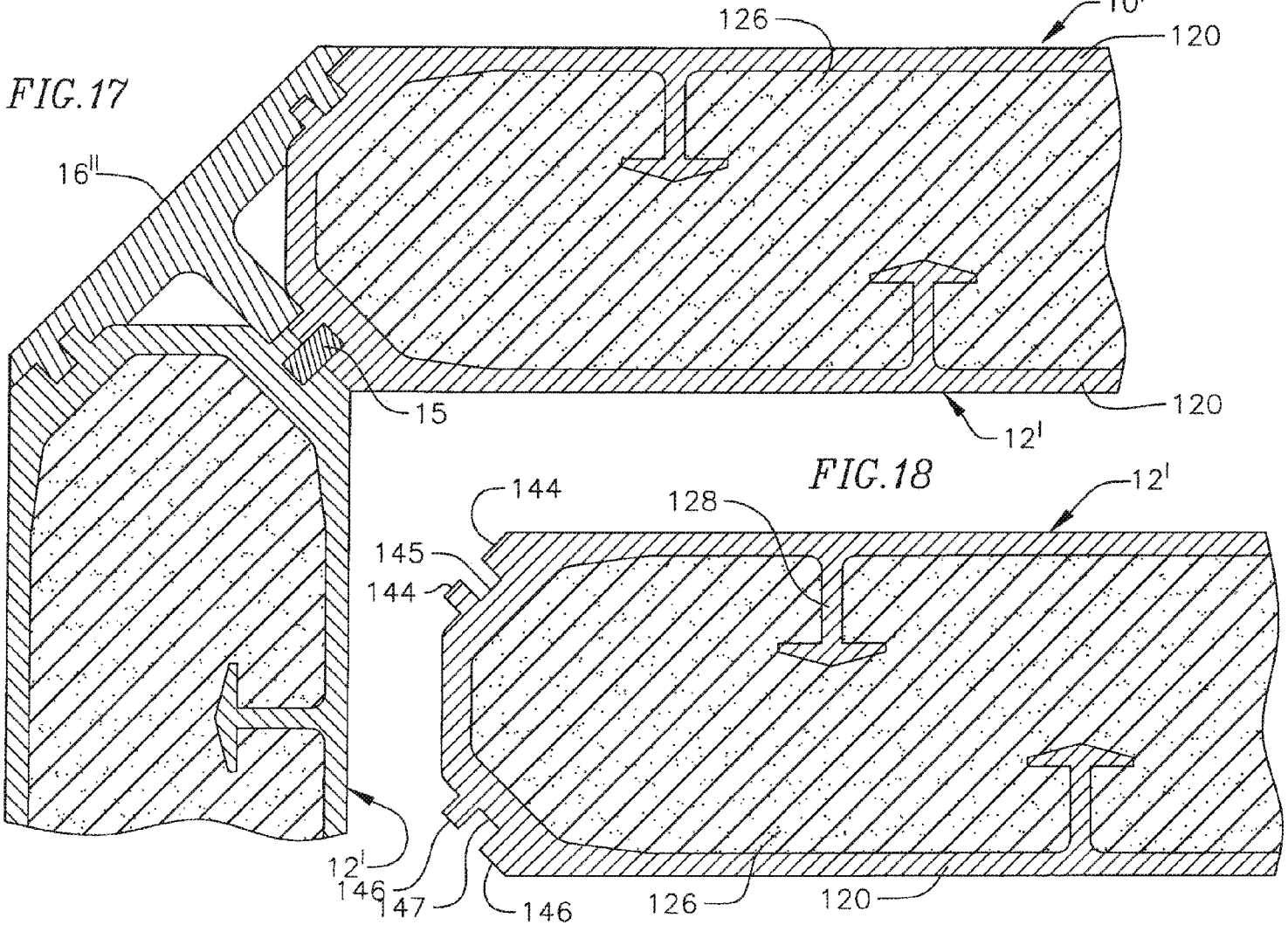
FIG. 17 is a sectional view of assembled components of a modular building structure according to another embodiment of the present invention.
FIG. 18 is a sectional view of a panel of the modular building structure of FIG. 17.

FIG. 17 shows a sectional view of assembled components of a modular building structure 10' according to one embodiment of the present invention which is a similar to the modular building structure 10 of FIG. 1 but which includes panels 12' of an alternative embodiment. The modular building structure 10' includes at least two panels 12', at least one coupling bar 15, and at least one edge coupler (e.g., the corner coupler 16"). As shown in FIG. 17, the two panels 12' of the modular building structure 10' are generally perpendicular to each other and are connected to each other utilizing the coupling bar 15 and the corner coupler 16, further locking the two panels 12' in place relative to each other. Unlike the modular building structure 10 of FIG. 1, the modular building structure 10' includes panels 12' which include integral panel connectors which further act as panel spacers.

With reference to FIG. 18, each of the panels 12' has an integral panel connector formed at its edges for coupling with other panels 12' of a modular building structure. As such, the structure of the panel 12' eliminates the need for separate panel spacers 13 and panel connectors 14 described above by integrally incorporating such elements into the panel 12'. Each of the panels 12' according to one embodiment is generally rectangular in shape and similar to the panels 12 described above and shown in FIG. 2. The panel 12' includes an outer skin 120 and an inner core 126. The outer skin 120 is different from the outer skins 20 of the panel 12 in that rather than including two separate outer skins 20 on either side of the panel 12, the outer skin 120 of the panel 12' is a continuous skin surrounding a perimeter of the panel 12'. That is, the outer skin 120 encloses the inner core 126 on four sides. The outer skin 120, in one embodiment, is formed of aluminum. Alternatively, the outer skin 120 may be formed of any other suitable material such as metal, plastic, fiberglass, or the like. In one embodiment, two opposing faces of the outer skin 120 are spaced such that the panel 12' has a thickness of between approximately 2½ inches (60 mm) and approximately 3 inches (75 mm). The outer skin 120, in one embodiment, has a thickness of approximately 0.18 inches. Like the inner core 26 of each of the panels 12, the inner core 126 of the panel 12' may be formed of a reticulated foam material. Alternatively, the inner core 126 may be formed of any other suitable material. Further, in one embodiment, the inner core 126 is bonded to inner surfaces of the outer skin 120 using a suitable adhesive. Alternatively, the inner core 126 may be fastened to the outer skin 120 via any other suitable materials or methods.

As shown in FIG. 18, each of the panels 12', in one embodiment, further includes one or more internal ribs or protrusions 128 extending inward from one or both of the opposing faces of the outer skin 120 for supporting and strengthening the inner core 126. The protrusions 128, as shown, may be tee-shaped, hook-shaped, or may include other suitably shaped features at the ends or along the sides of the protrusions 128 for improved adhesion to and/or support of the inner core 126. Further, each of the panels 12' incorporates some of the structural features and functionality of the panel connectors 14 described above. That is, edges of the panels 12', according to one embodiment, include a first abutting surface 144 oriented at an angle of approximately 45 degrees relative to a face of the panel 12' and a first groove 145 formed in the first abutting surface 144 extending along a length of the edge of the panel 12'. The panel 12' also includes a second abutting surface 146 substantially perpendicular to the first abutting surface 144, and a second groove 147 in the second abutting surface 146. The abutting surfaces 144, 146 and the grooves 145, 147 of the panels 12' have substantially the same structure and function as the abutting surfaces 44, 46 and the grooves 45, 47 of the panel connectors 14, 14', 14" described above.

The panels 12', according to one embodiment, are formed by pultrusion to provide a lower cost of manufacturing and a more fully automated production process. By forming the panel 12' by a pultrusion process, the entire panel 12', including the outer skin 120 (and the structural features of the panel connector 14 formed integrally therein) and the inner core 126 are formed together, rather than as separate components to be fastened together after the initial manufacturing process, such as in the field. Moreover, embodiments of a modular building structure incorporating the panel 12' instead of the panel 12 do not require the panel spacers 13. Additionally, in assembling a modular building structure including the panels 12', an assembly jig, as discussed above, may not be required because very close tolerances can be maintained in the pultrusion process (e.g., tolerances of less than 0.010 inches).

In general, panels such as panel 12' may be easily fabricated to include integral panel connectors on two opposite edges. However, such panels 12' are generally cut to length from a long panel 12', and therefore, will have two unfinished edges. Referring to FIG. 19, a sectional view of a portion of the modular building structure 10' illustrates how the unfinished edges of such a panel 12' may be completed. The modular building structure 100' is substantially similar to the modular building structure 100 described above and shown in FIG. 7. However, the modular building structure 100' includes the panels 12' with integral panel connectors on two of the four edges. The modular building structure 100' of FIG. 19 may be incorporated with a portion of another one of the embodiments of a modular building structure described above. With reference to FIG. 19, the modular building structure 100' includes at least three panels 12', at least two coupling bars 15, and at least one edge coupler (e.g., the edge coupler 18"). Further, the modular building structure 100' couples the panels 12' to one another at edges of the panels 12' that are cut (e.g., at a floor or a ceiling of a modular building structure). As such, the cut edges of the panels 12' do not include integral connectors (i.e. abutting surfaces 144, 146 and grooves 145, 147 described above), but rather are coupled to one another via panel connectors 14".

FIG. 20 shows a sectional view of a portion of a modular building structure 400' according to another embodiment of the present invention. The modular building structure 400' is substantially similar to the modular building structure 400 described above and shown in FIG. 13. However, the modular building structure 400' includes the panels 12' and thin panel 412' instead of the panels 12 and 412, and, as such, does not include the panel spacers 13. Moreover, the modular building structure 400' of FIG. 20 may be incorporated with a portion of another one of the embodiments of a modular building structure described above. With reference to FIG. 20, a thin panel 412' extending from a tee-shaped intersection of three panels may be used, for example, as a thin internal partition wall. The two other panels coupled end-to-end at the intersection may be two of the panels 12', the thin panel 412' substantially perpendicular to the panels 12'. Also, as shown in FIG. 20, the modular building structure 400', in one embodiment, may include another tee-shaped intersection at which an opposite end of the thin panel 412' is coupled substantially perpendicularly to two other panels 12' that are coupled end-to-end. The thin panel 412' substantially incorporates the structure and function of the tee coupler 440 described above with respect to the modular building structure 400, and, as such, the individual tee coupler 440 is not included in the modular building structure 400'. Further, the modular building structure 400', like the modular building structure 10' described above and shown in FIG. 19, couples the panels 12' to one another at edges of the panels 12' that are cut (e.g., at a floor or a ceiling of a modular building structure). As such, the cut edges of the panels 12' do not include integral connectors (i.e. abutting surfaces 144, 146 and grooves 145, 147 described above), but rather are coupled to one another via panel connectors 14".

Figure 21:
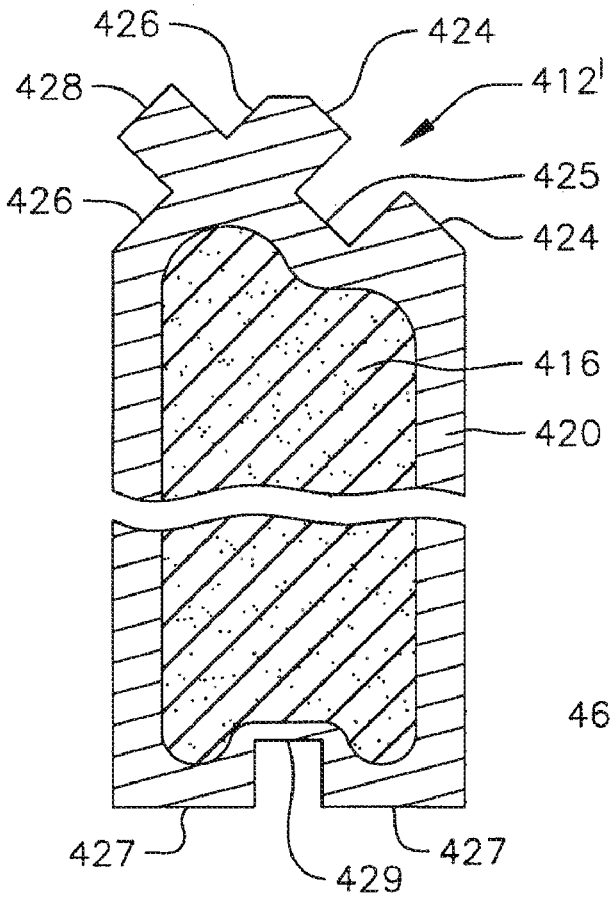
FIG. 21 is a sectional view of a panel of the modular building structure of FIG. 20.

With reference to FIG. 21, the thin panel 412' has a pultruded construction that is substantially similar to the panel 12' described above and shown in FIG. 18. That is, the thin panel 412' has integral connectors at its edges for coupling with other thin panels 412' of a modular building structure. However, like the thin panel 412 shown in FIG. 13, the thin panel 412' is a thin internal partition having a thickness, in one embodiment, of approximately 1¼ inches. The thin panel 412' has an outer skin 420 and an inner core 416 similar to the outer skin 120 and the inner core 126, respectively, of the panel 12'. Further, as shown in FIG. 21, one end of the thin panel 412' substantially incorporates the structure and function of the tee coupler 440 and an opposite end includes an abutting surface 427 and a groove 429 therein for receiving one of the coupling bars 15 therein for coupling to one of the tee couplers 450. In one embodiment, the first end includes a first abutting surface 424, a second abutting surface 426, a groove 425 formed in the first abutting surface 424, and a rib 428 protruding from the second abutting surface 426. The groove 425 is configured for receiving one of the coupling bars 15 therein for coupling to one of the panel connectors 14", and the rib 428 is configured to be received by one of the first and second grooves 45, 47 of another one of the panel connectors 14".

Figure 22:
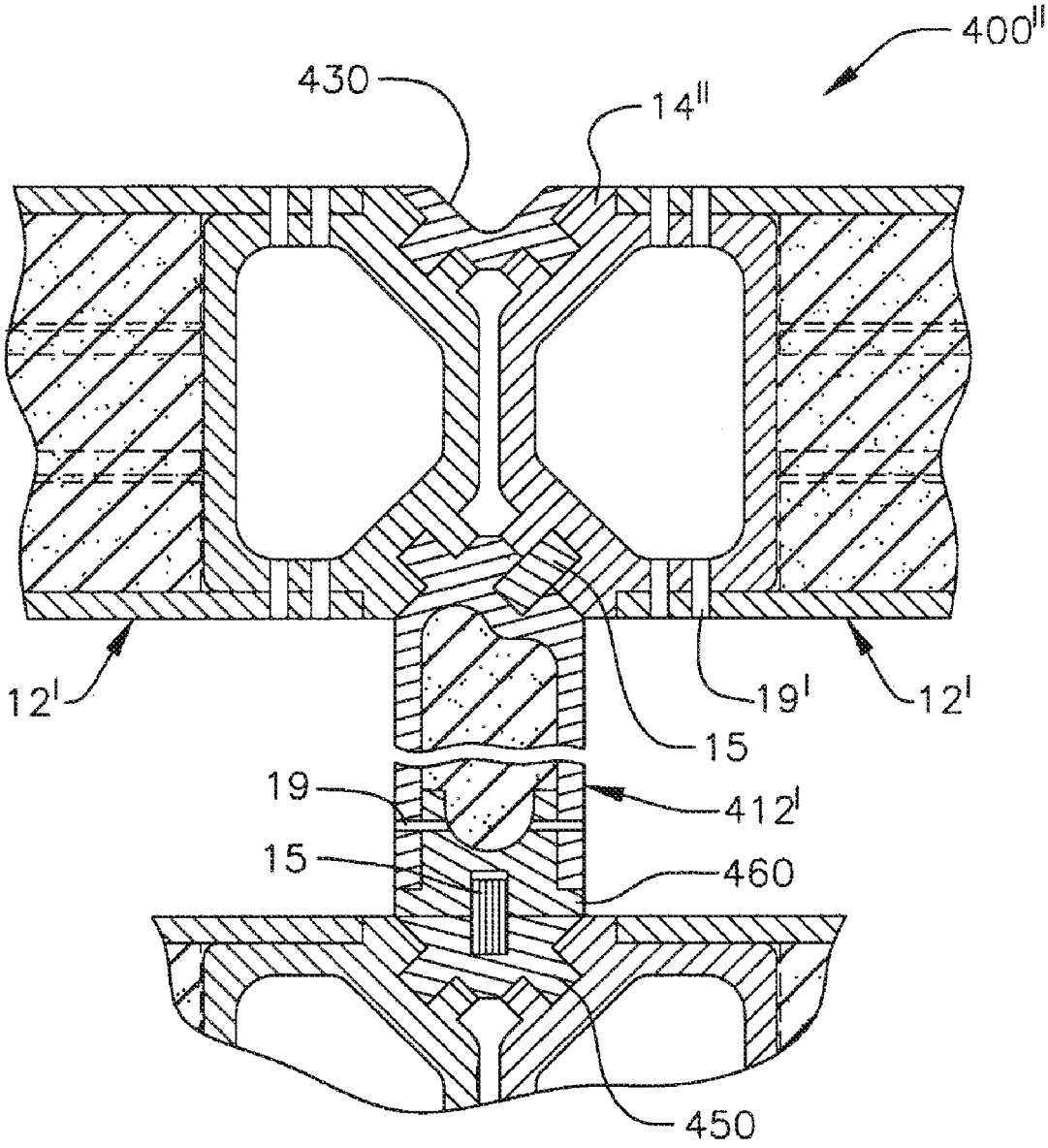
FIG. 22 is a sectional view of assembled components of a modular building structure according to another embodiment of the present invention.

FIG. 22 shows a sectional view of a portion of a modular building structure 400" according to another embodiment of the present invention. The modular building structure 400" is substantially similar to the modular building structure 400' described above and shown in FIG. 20. However, the modular building structure 400" couples the panel 412' to a pair of the panels 12' at an edge of the panel 412' that is cut (e.g., at a floor or a ceiling of a modular building structure). As such, the cut edge of the panel 412' does not include an integral connector, but rather is coupled at the cut edge via a panel connectors 460. Further, the modular building structure 400" of FIG. 22 may be incorporated with a portion of another one of the embodiments of a modular building structure described above.

Figure 23:
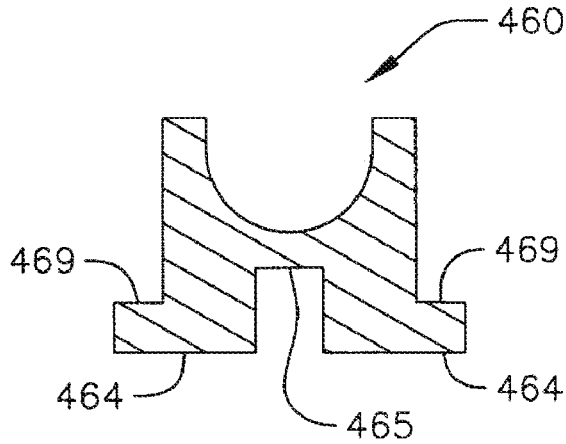
FIG. 23 is a sectional view of a panel connector of the modular building structure of FIG. 22.

With reference to FIG. 23, the panel connector 460 performs a similar function in conjunction with the thin panel 412' as the panel connector 14" does for the panel 12' and, as such, includes structural similarities to portions of the panel connector 14". The panel connector 460 includes steps 469 on opposite sides of the panel connector 460, similar to the steps 49" of the panel connector 14". The panel connector 460 is configured such that ends of the outer skins 420 of the panel 412' abut the steps 469 and outer surfaces of the panel connector adjacent the steps 469 closely contact inner surfaces of the outer skins 420 of the panel 412', as shown in FIG. 22, for example. The panel connector 460, in one embodiment, further includes a groove 465 for receiving one of the coupling bars 15 therein for coupling to one of the tee couplers 450.

As described above, a modular building structure, according to an embodiment of the present invention, may include components from one or more of the modular building structures 10, 100, 200, 300, 400, 10', 400', 400" described above and shown in FIGS. 1, 7, 9, 11, 13, 17, 19, 20, and 22, respectively.

For example, one embodiment of a modular building structure is a five-sided box including a plurality of panels perpendicular to each other, and also including a plurality of corner couplers located near the intersections of the perpendicular panels. The five-sided box, for example, may have first and second side wall panels forming two side walls of the five-sided box and arranged opposite from and substantially parallel to each other. The first and second side wall panels, in one embodiment, may be approximately 15 feet (4.5 m) long and approximately 10 feet (3 m) high. The five-sided box may further include roof and floor panels 12 forming a top and a bottom of the five-sided box, the roof and floor panels 12 opposite from and substantially parallel to each other, and each being connected to the first and second side wall panels. The roof and floor panels may have substantially the same dimensions as the first and second side wall panels. The five-sided box also has an end wall panel connected to and substantially perpendicular to each of the first and second side wall panels, and to the roof and floor panels. According to this embodiment, the end wall panel may be approximately 10 feet (3 m) wide and approximately 10 feet (3 m) high. The various panels of the five-sided box are connected using a plurality of panels spacers, panel connectors, coupling bars, and corner couplers, as described above with respect to the modular building structure 10.

To assemble a five-sided open box described above, five panel sub-assemblies are assembled, each including the a panel 12 with panel spacers 13 at each edge, and a panel connector 14 at each panel spacer. For convenience, the individual panel sub-assemblies will be referred to as a floor sub-assembly, first and second side wall sub-assemblies, a rear wall sub-assembly, and a roof sub-assembly, though the components are generally interchangeable and the orientation of the completed box or the individual panels is not relevant. The floor sub-assembly, is first placed flat on a flat assembly surface and a coupling bar is placed in the upwardly facing of the first and second grooves of the panel connector such that approximately one half of the coupling bar 15 is extending from the groove. Next, the first side wall sub-assembly is placed in a position perpendicular to a corresponding edge of the floor sub-assembly such that the coupling bar engages the inwardly facing groove of the lower panel connector of the first side wall sub-assembly with only a small amount of force. The first side wall sub-assembly, positioned vertically and perpendicular to the floor sub-assembly will connect firmly to the floor sub-assembly and will align itself. Short lengths of the corner couplers 16 may be inserted in order to lock the sub-assemblies together temporarily. This can be useful if, for example, assembly is interrupted or there is rough handling during assembly.

To continue assembly of the five-sided box, a second side wall sub-assembly is connected perpendicular to the floor sub-assembly and opposite the first wall sub-assembly in the identical way that the floor and first wall sub-assemblies were assembled. Then, another coupling bar is inserted in a groove of the end panel connector of the floor sub-assembly and the rear wall sub-assembly is slid into place with the coupling bar mating with the corresponding groove of the lower panel connector of the rear wall sub-assembly. Short lengths of corner couplers are inserted to temporarily hold the rear wall sub-assembly to the floor sub-assembly. The rear wall sub-assembly is then linked to the first side wall sub-assembly by inserting a coupling bar from the top of the assembly, into the coupling channel defined by the adjacent grooves of the panel connector of the rear wall sub-assembly and the panel connector of the first side wall sub-assembly. The rear wall sub-assembly and the first side wall sub-assembly are locked together with lengths of corner couplers. The rear wall sub-assembly is then locked to the second side wall sub-assembly in the same way.

Finally, a coupling bar is inserted into the appropriate groove of the top panel connector of the first side wall sub-assembly and the roof sub-assembly is lowered into position with the appropriate groove of the panel connector of the roof sub-assembly mating with the coupling bar of the panel connector of the first side wall sub-assembly. The first side wall sub-assembly and the roof sub-assembly are locked together with lengths of corner couplers. Then the roof sub-assembly is linked to the second side wall sub-assembly by inserting a coupling bar from one end into the coupling channel defined by the adjacent grooves of the panel connector of the roof sub-assembly and the top panel connector of the second side wall sub-assembly. The roof sub-assembly and the second side wall sub-assembly are locked together with lengths of corner couplers. The roof sub-assembly is then locked to the rear wall sub-assembly in the same way. At this point, if only short lengths of corner couplers were used for temporary assembly of the various joints, they are replaced with appropriate lengths of corner couplers to provide continuous edge seams at adjacent sub-assemblies. The result is an extremely strong open-ended box. If desired, the open-ended box can be enclosed by assembling a front wall sub-assembly similar to those described above, and closing off the box with the front wall sub-assembly using four coupling bars and four lengths of corner couplers using techniques as set forth above.

Another embodiment of a modular building structure includes linking two such five-sided boxes to one another to form a larger six-sided enclosed box. In one embodiment, the enclosed box includes a dividing wall completely dividing the interior of the enclosed box into two regions, each region defined by one of the five-sided boxes. In another embodiment, the enclosed box may include two stub walls inside the enclosed box, the stub walls defining two interior regions that are not completely divided. Further, the enclosed box may have at least one opening on one or more of the six sides to provide access to the interior of the enclosed box. The panels that make up the box can be either precut to include windows or doors, or such openings can be cut after the box is assembled. Once a box is assembled, any open joints may be sealed utilizing any suitable sealant to provide protection against the environment.

To assemble the enclosed box from two five-sided boxes divided into two regions, an interior wall sub-assembly is assembled using a interior wall panel, four panel spacers, one at each edge of the interior wall panel, and a panel connector at each panel spacer. Two coupling bars are placed into the corresponding channels of the panel connectors of two adjacent panel sub-assemblies of one box, for example, the floor sub-assembly and the first side wall sub-assembly. The interior wall panel is slid into place with the grooves of the corresponding panel connectors mating with the two coupling bars. Two more coupling bars are slid into the coupling channels formed by the remaining two panel connectors of the interior wall sub-assembly and the second side wall sub-assembly and the roof sub-assembly to fully couple the interior wall to the first five-sided box.

Once the interior wall is coupled to the first five-sided box, another coupling bar is slid into place at the bottom panel connector of the interior wall sub-assembly and the second five-sided box is snugged up against the first five-sided box with the coupling bar mating with the panel connector of the floor sub-assembly of the second five-sided box. Two more coupling bars are slid into the coupling channels formed by the side panel connectors of the interior wall sub-assembly and the first and second side wall sub-assemblies of the second five-sided box. The final coupling bar is then slid into the coupling channel formed by the top panel connector of the interior wall sub-assembly and the panel connector of the roof sub-assembly of the second five-sided box to fully couple the interior wall to the second five-sided box. Then, four lengths of straight couplers are slid into position, covering the top, bottom, and side joints formed where the first and second five-sided boxes are joined.

It should be noted that the box assemblies of the present invention are very sturdy. It should also be recognized that due to tight tolerances, it can be difficult to slide a coupling bar into a coupling channel of adjacent walls of a partially assembled box. However, because the structure is so sturdy, the length of the corresponding coupling bars need not extend the full length of the corresponding panel connectors. The coupling bars need only extend about one-third or one-half of the length of the corresponding panel connectors to provide a secure connection.

While this invention has been described in connection with what are considered to be exemplary embodiments, it is to be understood that the invention is not limited to the disclosed embodiments, dimensions, and configurations, but, on the contrary, also extends to various modifications and equivalent arrangements. For example, while the invention has been described with either generally straight or generally perpendicular connections between panels, one of ordinary skill in the art could easily modify the features of various embodiments of the invention to include connections for joining panels at any angle.

What is claimed is:

1. A modular building structure comprising:

a plurality of panels, each panel comprising a pair of generally parallel outer skins sandwiching an inner core;

a plurality of panel spacers, each panel spacer adapted to hold the outer skins of a panel of the plurality of panels spaced from one another along an edge of the panel extending in a longitudinal direction, each panel spacer defining a pair of flanges, each flange abutting a respective outer skin of the outer skins of the panel;

a plurality of panel connectors, each panel connector defining an outer groove and a pair of inner slots, each of the inner slots adapted to receive and mate with one of the outer skins together with a respective abutting flange of the pair of flanges of an adjacent panel spacer of the plurality of panel spacers, and the outer grooves of adjacent panel connectors of said plurality of panel connectors adapted to align with one another to form a substantially enclosed coupling channel extending in the longitudinal direction when the panels are arranged generally perpendicular to and adjacent one another, the coupling channel having a substantially rectangular cross-sectional shape in a plane perpendicular to the longitudinal direction;

at least one coupling bar adapted to fit within the substantially enclosed coupling channel to couple the adjacent panel connectors to one another; and at least one edge coupler adapted to lock two or more of said adjacent panel connectors to one another.

2. The modular building structure of claim 1, wherein the at least one coupling bar comprises a plurality of coupling bars, each adapted to fit within the coupling channel of a pair of adjacent panel connectors of the plurality of panel connectors to couple the pair of adjacent panel connectors to one another.

3. The modular building structure of claim 1, wherein the at least one edge coupler comprises a plurality of edge couplers, each adapted to lock two or more of said adjacent panel connectors to one another.

4. The modular building structure of claim 3, wherein the plurality of edge couplers comprises:

a plurality of corner couplers adapted to couple a pair of panel connectors of the plurality of panel connectors that correspond to generally perpendicular panels of the plurality of panels; and at least one straight coupler adapted to couple three adjacent panel connectors of the plurality of panel connectors, wherein two of the three adjacent panel connectors correspond to first and second panels of the plurality of panels that are in the same general plane as one another, and the third of the three adjacent panel connectors corresponds to a third panel of the plurality of panels that is generally perpendicular to the first and second panels.

5. The modular building structure of claim 3, further comprising a cross-shaped coupler adapted to couple two pairs of panel connectors of the plurality of panel connectors that correspond to generally perpendicular panels.

6. The modular building structure of claim 1, wherein said at least one edge coupler and two or more of said adjacent panel connectors together define a plurality of interlocking ribs adapted to lock said at least one edge coupler to the two or more of said adjacent panel connectors.

7. The modular building structure of claim 1, wherein said at least one edge coupler comprises an aluminum extrusion.

8. The modular building structure of claim 1, wherein the inner core comprises foam.

9. A modular building structure comprising:

at least two panels adapted to be arranged generally perpendicular one another each panel comprising a pair of generally parallel outer skins sandwiching an inner core;

at least two panel spacers, each panel spacer adapted to hold the outer skins of one of the at least two panels spaced from one another along an edge of the panel extending in a longitudinal direction;

at least two panel connectors, each panel connector associated with and extending longitudinally along one of the at least two panel spacers, each panel connector defining matching first and second outer grooves running parallel to the edge of the one of the at least two panels and arranged symmetrically about the panel connector in a longitudinal direction; wherein adjacent panel connectors are adapted to align with one another such that the first outer groove of a first panel connector of the adjacent panel connectors of said plurality of panel connectors aligns with the first outer groove of a second panel connector of the adjacent panel connectors to form a substantially enclosed coupling channel when the ones of the at least two panels are arranged generally perpendicular one another, the coupling channel having a substantially rectangular cross-sectional shape in a plane perpendicular to the longitudinal direction;

at least one coupling bar adapted to fit within the substantially enclosed coupling channel; and at least one edge coupler defining first and second longitudinal ribs, the first rib adapted to fit within the second outer groove of the first panel connector, and the second rib adapted to fit within the second outer groove of the second panel connector.

10. The modular building structure of claim 9, wherein the at least one coupling bar has a substantially rectangular cross-sectional shape in the plane perpendicular to the longitudinal direction.

11. The modular building structure of claim 9, wherein the at least one coupling bar has a cross-sectional shape and size in the plane perpendicular to the longitudinal direction that are substantially the same as the cross-sectional shape and a cross-sectional size of the substantially enclosed coupling channel in the plane perpendicular to the longitudinal direction.

12. The modular building structure of claim 9, wherein at least one of the panel connectors is integral with a corresponding panel spacer.

* * * * *